US008007423B2

(12) United States Patent
Solow et al.

(10) Patent No.: US 8,007,423 B2
(45) Date of Patent: Aug. 30, 2011

(54) COLLAPSIBLE EXERCISE CHAIR

(75) Inventors: Howard J. Solow, Boulder, CO (US); James V. Osburn, Lafayette, CO (US); Julie Lobdell, Longmont, CO (US); Jeffery T. Samson, Boulder, CO (US)

(73) Assignee: Mad Dogg Athletics, Inc., Venice, CA (US)

( * ) Notice: Subject to any disclaimer, the term of this patent is extended or adjusted under 35 U.S.C. 154(b) by 0 days.

(21) Appl. No.: 12/304,561

(22) PCT Filed: Jun. 12, 2007

(86) PCT No.: PCT/US2007/070938

§ 371 (c)(1),
(2), (4) Date: Dec. 12, 2008

(87) PCT Pub. No.: WO2007/146902

PCT Pub. Date: Dec. 21, 2007

(65) Prior Publication Data

US 2009/0270235 A1 Oct. 29, 2009

Related U.S. Application Data

(60) Provisional application No. 60/804,751, filed on Jun. 14, 2006.

(51) Int. Cl.
*A63B 26/00* (2006.01)

(52) U.S. Cl. ..... 482/142; 482/145; 482/148

(58) Field of Classification Search ..... 482/130, 482/91, 92, 121, 125, 142–148; 434/247
See application file for complete search history.

(56) References Cited

U.S. PATENT DOCUMENTS

| | | | | |
|---|---|---|---|---|
| 1,887,234 | A | 11/1932 | Copenhaver | |
| 5,002,271 | A | 3/1991 | Gonzales | |
| 5,380,262 | A | 1/1995 | Austin | |
| 5,681,250 | A | 10/1997 | Hoover et al. | |
| 5,902,220 | A * | 5/1999 | Lin | 482/142 |
| 6,338,493 | B1 | 1/2002 | Wohlgemuth et al. | |
| 6,634,997 | B2 | 10/2003 | Breibart et al. | |
| 6,916,279 | B2 | 7/2005 | Endelman | |
| 7,381,172 | B1 * | 6/2008 | Gehrke | 482/146 |
| 7,445,586 | B2 | 11/2008 | Gibson | |
| 7,608,030 | B2 * | 10/2009 | Splane | 482/142 |
| 2003/0078143 | A1 | 4/2003 | Breibart et al. | |
| 2004/0138034 | A1 | 7/2004 | Endelman | |
| 2009/0197746 | A1 | 8/2009 | Splane et al. | |

OTHER PUBLICATIONS

Advertisement: Peak Body Systems, Inc. d/b/a Peak Pilates, *New EXO Chair*, 1 page, date unknown.

* cited by examiner

*Primary Examiner* — Glenn Richman
(74) *Attorney, Agent, or Firm* — Jones Day

(57) ABSTRACT

An exercise chair of the type wherein a user can sit on a seating platform and extend and retract his legs while his feet are resting on a spring-resisted foot rod includes a structure which permits the chairs to be stacked in nested relationship or a structure using foldable support legs for a seating platform allowing the seating platform to be folded into close relationship with a base frame for storage purposes.

13 Claims, 20 Drawing Sheets

COLLAPSIBLE EXERCISE CHAIR

CROSS REFERENCE TO RELATED APPLICATION

This application is a PCT international application corresponding to and claiming priority to U.S. provisional application No. 60/804,751, filed Jun. 14, 2006, the disclosure of which is hereby incorporated by reference.

BACKGROUND OF THE INVENTION

1. Field of the Invention

A chair for use by an individual during exercise, which can be stackable or foldable, includes a seat platform mounted on a base with the base movably supporting a pivotal transverse bar on which is mounted a stanchion carrying a foot-engaging rod on its free or distal end. Adjustable spring resistance connects the seat to the stanchion so that a user seated on the platform can, for example, place his or her feet on the transverse rod and move the rod in a reciprocating pattern during an exercise.

2. Description of the Relevant Art

Exercise by human beings has become increasingly popular for health and other related reasons. Such exercise takes numerous forms including aerobics, strengthening and more recently exercises related to Pilates, Gyrotonics and the like. Some of these exercises can be done without equipment while others require equipment. One exercise associated with Pilates requires a chair having a spring resistive foot rod which a user can reciprocally move with his feet. An exercise chair for use in such an exercise is shown in U.S. Pat. No. 6,634,997. Inasmuch as these chairs can be used at home or in a class setting where there are numerous such chairs, storage for the chairs becomes an issue. For example, a chair of the type shown in the afore-described U.S. patent, if used in a class setting, requires substantial space for storage when there are a plurality of such chairs. Accordingly, while the chair itself serves a useful purpose, it would be far more desirable if it could be stored in a manner requiring less space which, of course, is valuable in exercise facilities such as health clubs.

It is to provide an improved exercise chair that can be stored in a small amount of space that the present invention has been developed.

SUMMARY OF THE INVENTION

The exercise chair of the present invention has been designed to be nestably stacked or foldable so as to conserve space when a plurality of the chairs are placed in storage.

In one embodiment, the chair includes an open base having a seat platform supported thereon with a plurality of support legs which taper inwardly and upwardly to the seat platform that is smaller than the opening in the base. A movable transverse support bar is connected to the base so as to be positionable in an operative or storage position. The support bar is also pivotal about its longitudinal transverse axis and supports a stanchion having a transverse foot rod mounted on a distal end thereof in substantially parallel relationship with the movable bar. The stanchion is attached to coil springs operably anchored to the seat platform and slidably connected to the stanchion to adjustably resist pivotal movement of the stanchion about the movable bar.

In one operative position, the foot rod is spaced from the seating platform so that a user of the chair can sit on the platform while placing his feet on the foot rod and reciprocally pivot the foot rod away from the seat platform where it will be returned by the coil springs. When the movable bar is placed in the storage position, the movable bar, foot rod and the stanchion interconnecting the two are positioned so as not to inhibit the stacking of one chair on another. The inwardly and upwardly tapered support legs for the seating platform permit the relatively large, open base to be passed over the seating platform of the next adjacent lower seat so the open base rests on the tapered support legs in a nesting relationship.

In another embodiment of the present invention, the chair is foldable so that the seat platform can be folded into closely adjacent relationship with the open base of the chair. In one arrangement of the foldable chair, the seat platform folds longitudinally in line with the open base and in other arrangements, it folds transversely relative to the base, but in any instance, the seat platform in its folded position is in close relationship with the open base so that minimal space is required for storing the folded chair.

Other aspects, features and details of the present invention can be more completely understood by reference to the following detailed description of a preferred embodiment, taken in conjunction with the drawings and from the appended claims.

DESCRIPTION OF THE PREFERRED EMBODIMENTS

Figure 1:
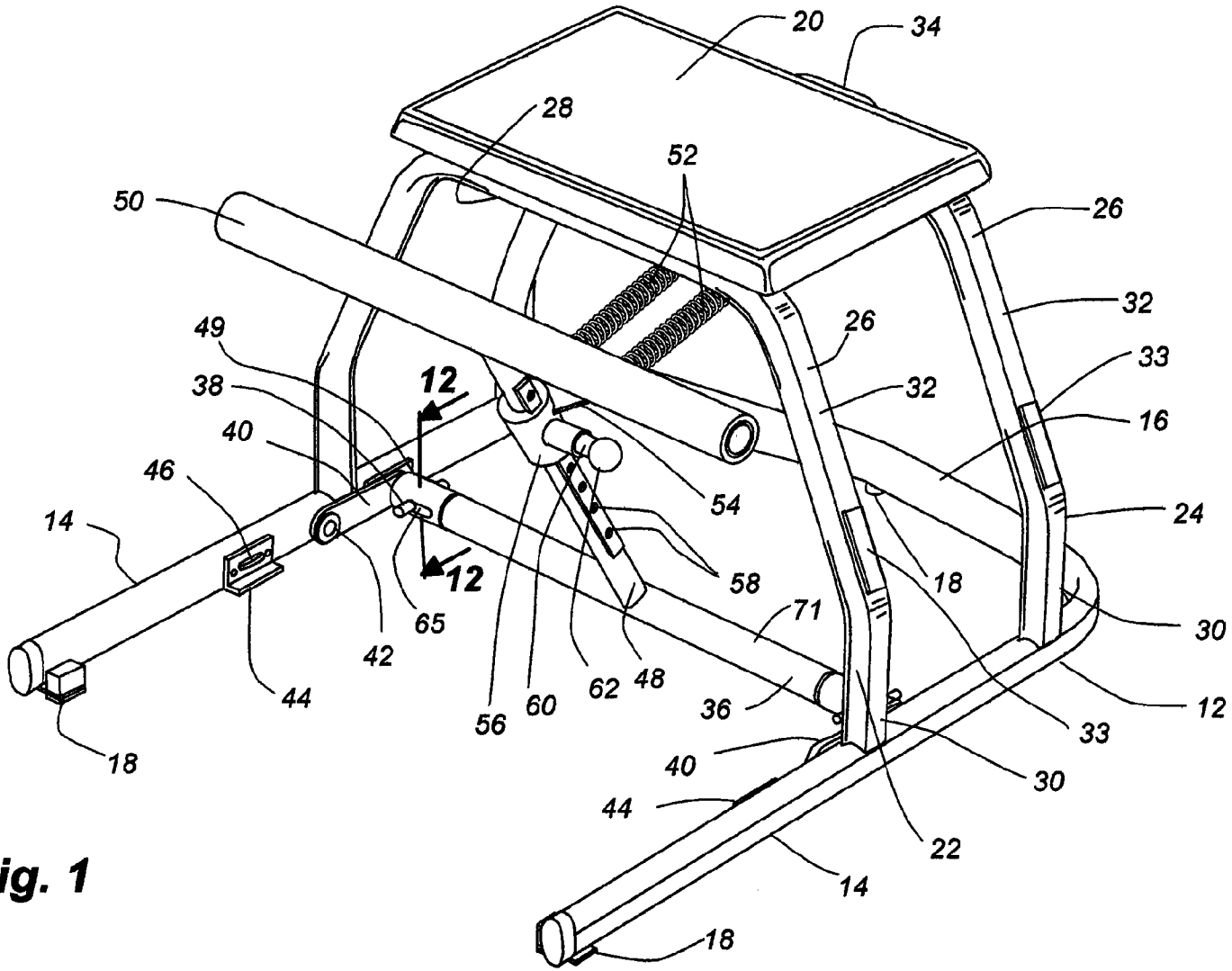
FIG. 1 is an isometric of a first embodiment of the present invention showing the movable bar in its operative position.
Figure 2:
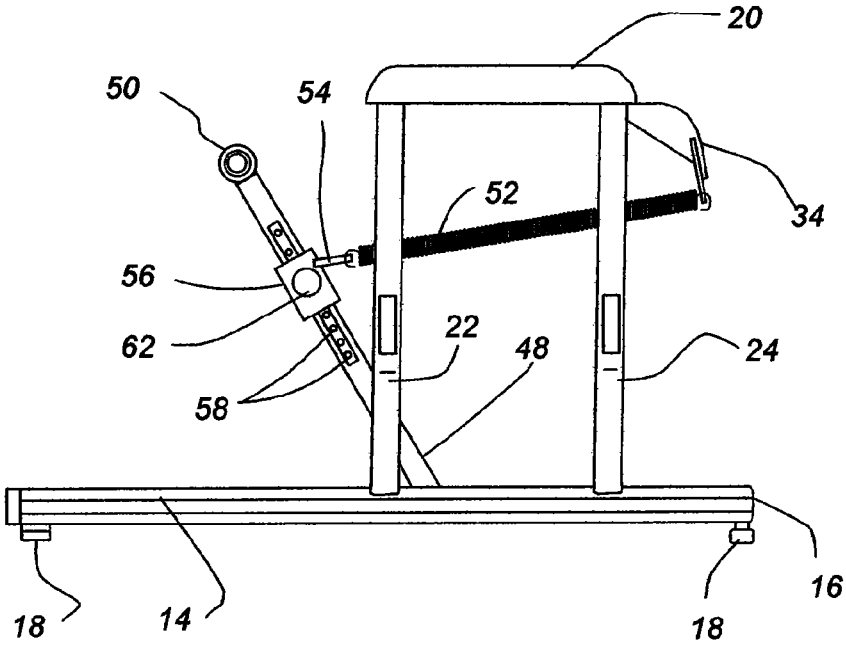
FIG. 2 is a left side elevation of the chair of FIG. 1.
Figure 3:
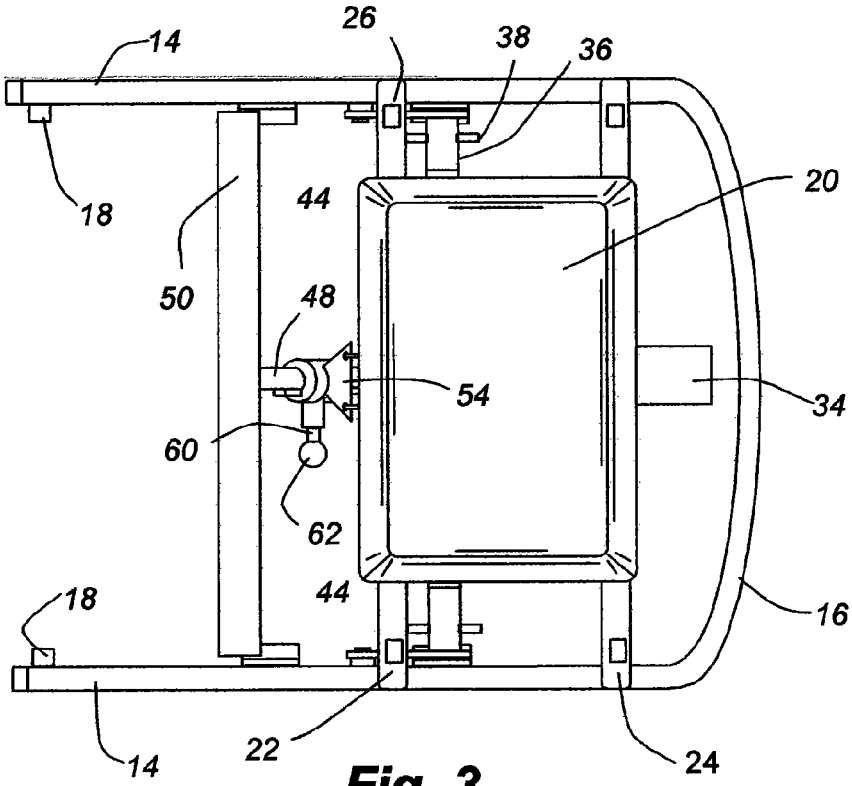
FIG. 3 is a top plan view of the chair of FIG. 1.

A first embodiment of the exercise chair of the present invention is shown in FIG. 1 to include an open generally U-shaped base frame 12 made for example of tubular steel, aluminum, plastic, or the like, having sides 14 and an end 16 interconnecting the sides at one end thereof. The sides are spaced a pre-determined distance which will become apparent hereafter. Ground or floor engaging pads 18 may be provided along the length of the base to elevate the base from a supporting surface if desired. A seating platform 20 is mounted in an elevated position from the base by a pair of parallel front 22 and rear 24 support leg structures which are generally inverted U-shaped in configuration. Each leg structure therefore defines a pair of side legs 26 and a top leg 28. The side legs have a lower vertical component 30 and an upper inwardly tapering component 32 having rubber strips or bumper pads 33 thereon for a purpose to be described later. The top leg is secured to the seating platform in any suitable manner as with bolt type fasteners. The lower end of each side leg is welded, screwed, or otherwise secured to a side of the base so that the seating platform is vertically supported and horizontally oriented above the base. The support leg structures are spaced forwardly from the end 16 of the base for a purpose to become clear hereafter and an anchor or mounting bracket 34 is secured along the rear edge of the seating platform so as to depend downwardly. The bracket can also be secured to the rear support leg structure if desired.

Figure 5:
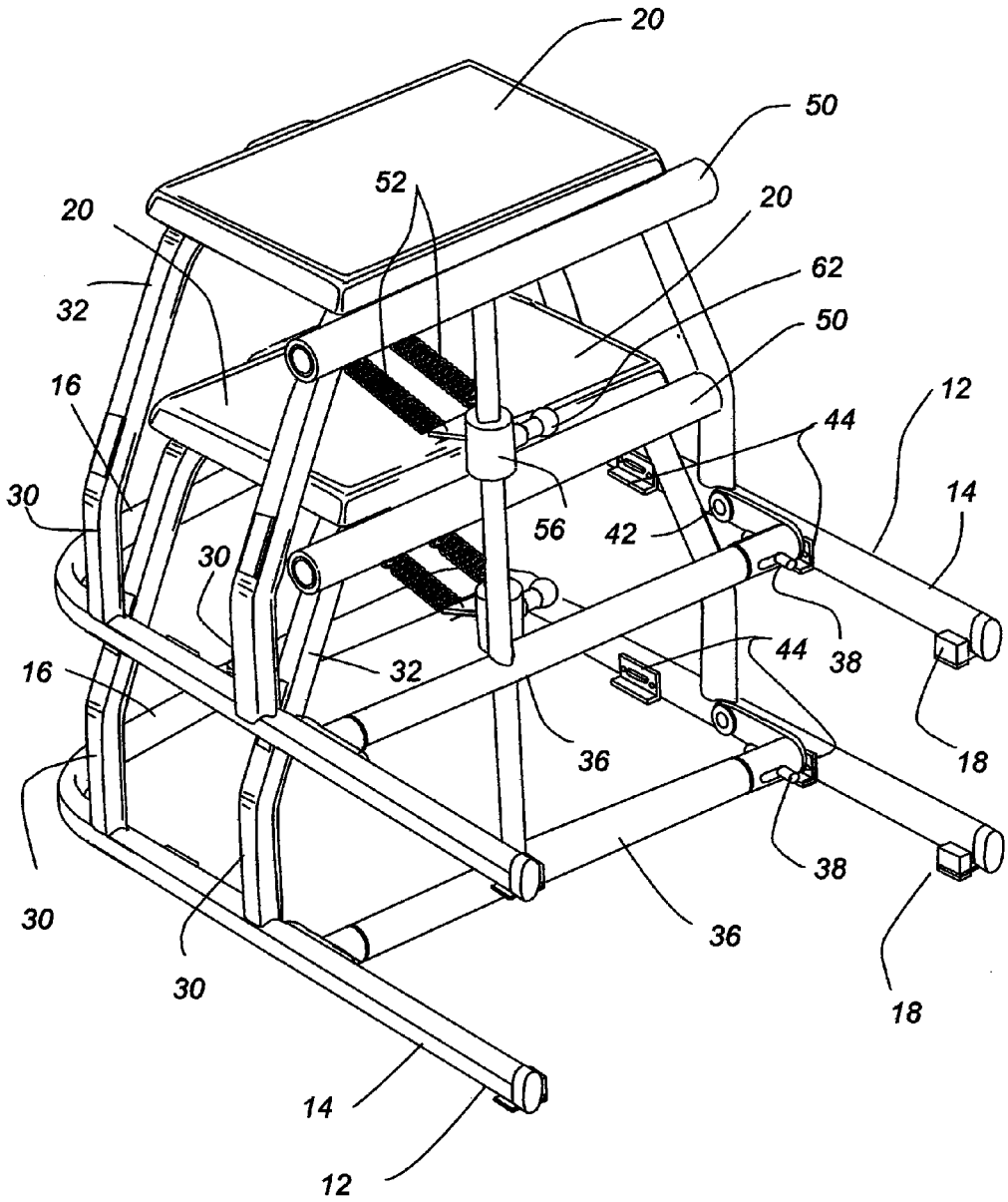
FIG. 5 is an isometric of the two nestably stacked chairs of FIG. 4.

A movable transverse bar 36 bridges the space between the two sides 14 of the base 12 in a perpendicular relationship therewith and approximately midway along the length of the sides. The movable bar is movable between an operative position as shown in FIG. 1 which is behind the front leg support structure 22 and a storage position as shown in FIG. 5 in front of the front leg support structure. The operative and storage positions are displaced longitudinally of the sides 14. The movable bar has depressible plungers 37 (FIG. 12) on opposite ends thereof which are spring biased outwardly in an axial direction from each end of the movable bar. The plungers can be retracted with a transverse finger pin 38 at each end of the movable bar. The plungers extend through holes in the free ends of a pair of pivotal links 40, the opposite ends of which are pivotally connected to an associated side 14 of the base with a pivot pin 42. The links permit the movable bar to swing or be pivoted between the operative position of FIG. 1 and the storage position of FIG. 5. The movable bar is supported in either the operable or storage position by support brackets 44 that are secured to the sides of the base at longitudinally spaced locations so as to be alignable with the ends of the movable bar. Each support bracket has a slot 46 therein that releasably receives a plunger 37 at the associated end of the movable bar so that the movable bar can be positively but releasably retained in either the operative position of FIG. 1 or the storage position of FIG. 5. The plunger can be withdrawn from a support bracket without being removed from the associated link thereby freeing the movable bar for swinging movement between the operative and storage positions.

Figure 12:
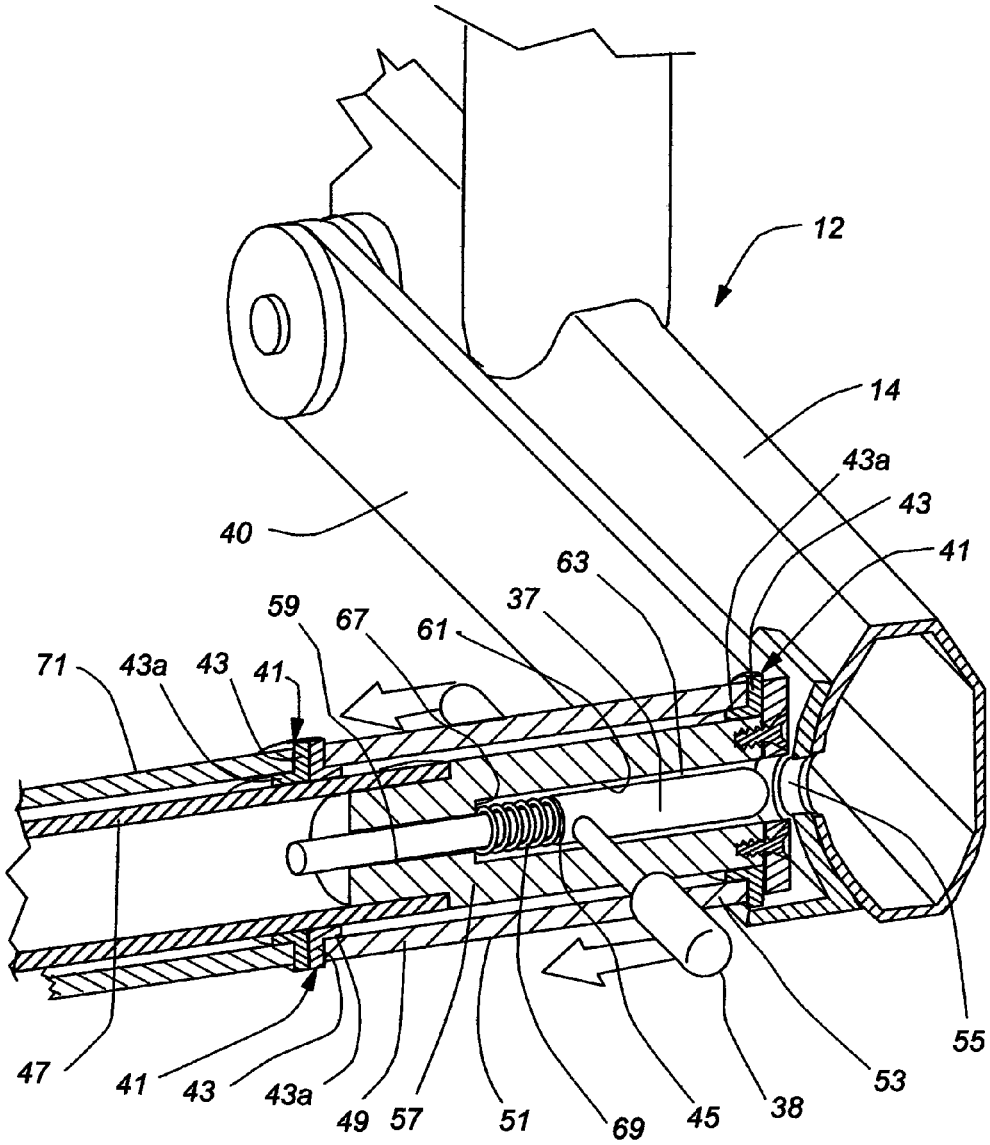
FIG. 12 is an enlarged fragmentary section taken along line 12-12 of FIG. 1.

As probably best seen in FIG. 12, the movable transverse bar 36 in the preferred embodiment, is comprised of a hollow support tube 47 that extends most of the full width between the sides 14 of the base frame 12 with the support tube being welded internally at each end around the periphery of inner ends of internal rods 57. An extension tube 51 surrounds each rod 57 and is held in radially spaced relationship therefrom by flanged bushings 41. A hollow sleeve 71 pivotally surrounds the support tube 47 in axial alignment with the extension tubes 51 and is separated from the extension tubes by a pair of identical flanged bushings 41. The flanged bushings have a large diameter portion 43 that abuts adjacent ends of the hollow sleeve and/or the extension tubes and a small diameter portion 43*a* having an outer surface that is press fit within the adjacent open end of the hollow sleeve or extension tube and an inner surface slidably engaged with the support tube 47 or the rod 57. The outer end of each internal rod 57 is screwed or otherwise attached in perpendicular relationship with a free end of an associated link 40 in alignment with a hole 55 in the link through which a plunger 37 mounted in each internal rod slidably projects. The internal rod 57 has an axial hole 59 through its inner end that communicates with a larger axial chamber 61 that opens through its outer end 63. The plunger has an inner small diameter segment that slides within the axial hole 59 and a large diameter segment that slides within the axial chamber 61. A shoulder 45 is defined on the plunger between the large and small diameter segments. The plunger has the transverse finger pin 38 secured thereto within the axial chamber. The finger pin extends through the plunger and through slots 65 (FIG. 1) in the extension tubes for access to a user. The axial chamber defines a shoulder 67 against which a coil spring 69 is seated in circumferential relationship with the plunger 37 and in abutment at its opposite end with the shoulder 45. The coil spring, therefore, biases the plunger axially outwardly. The plunger can be retracted, however, by the finger pin as when the transverse movable bar 36 is being pivoted relative to the base frame. The afore-described arrangement is positioned at each end of the movable transverse bar so the movable transverse bar can be releasably anchored to each side 14 of the base frame 12 in two different positions.

The hollow sleeve 71 is pivotally mounted on the support tube 47 and abuts a bushing 41 at each end so it cannot slide axially. The sleeve has the rigid stanchion 48 fixed thereto which extends radially away from the sleeve at a centered location along the length of the sleeve. The stanchion has a rigid foot engagement rod 50 fixably mounted perpendicularly across its free or distal end so as to define locations where a user of the exercise chair can place his feet or hands during exercise.

It will be appreciated from the above, the foot rod 50 is therefore pivotal about the support tube with this movement being restrained by a pair of coil springs 52 anchored at a rear end to the mounting bracket 34 on the seat platform 20 and at a front end to a flange 54 on a slide or sleeve 56 which is axially movable along the length of the stanchion 48. The stanchion includes a plurality of laterally opening detents 58 along its length for releasable receipt of a pin 60 mounted in the sleeve and spring-biased radially inwardly. A finger knob 62 is provided on the pin for retracting the pin from a detent in the stanchion so the slide can be moved along the length of the stanchion between any one of a plurality of fixed positions. Each position is a different distance from the movable bar 36 changing the leverage provided by the stanchion 48. By adjusting the tension in the springs, of course, the resistance to pivotal movement of the foot rod 50 by a user of the device can be pre-selected.

Figure 4:
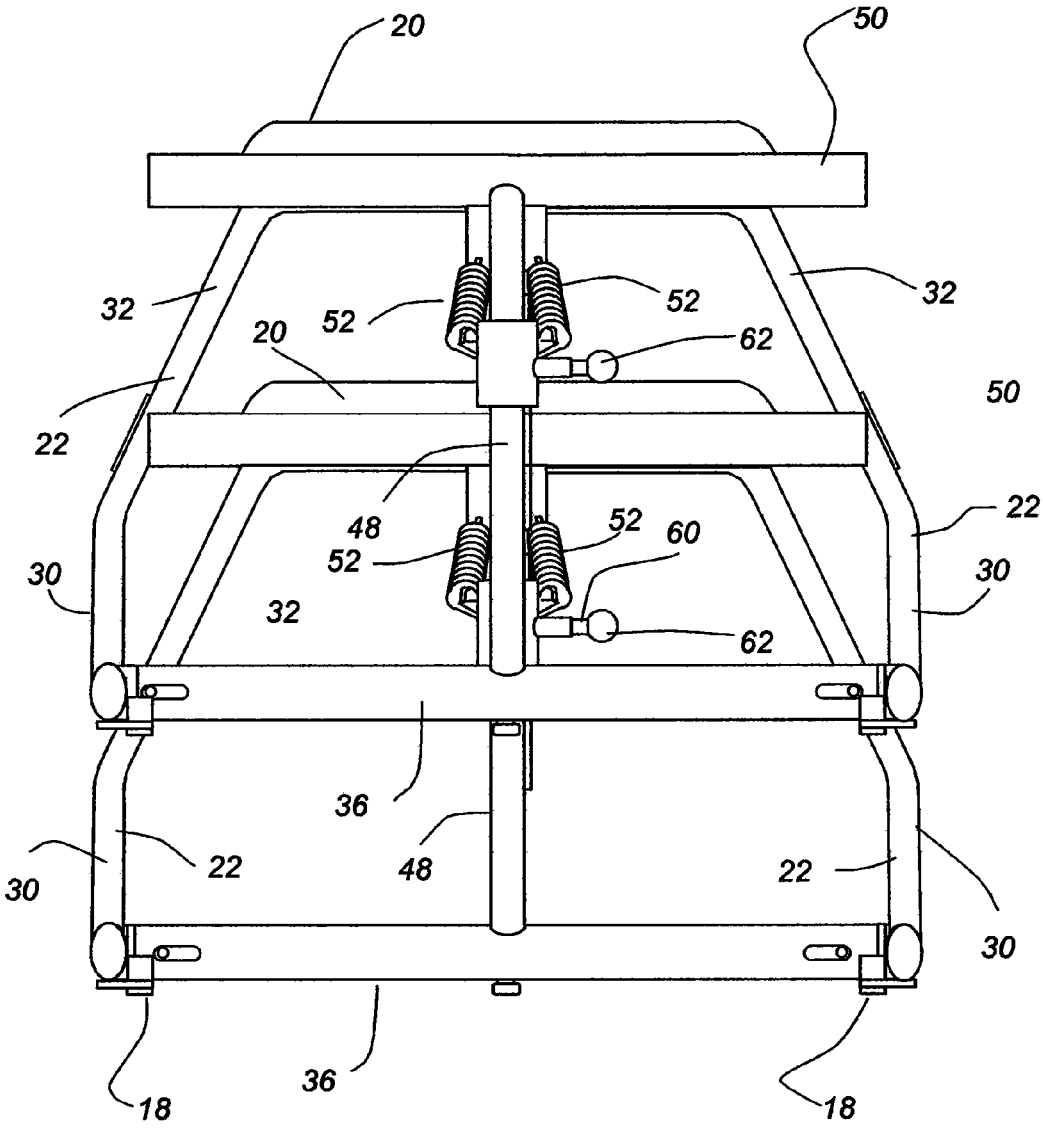
FIG. 4 is a front elevation of two nestably stacked chairs of the type shown in FIG. 1.

It is important to note the seating platform 20 has a width that is less than the spacing between the sides 14 of the base 12 and further that the seating platform is spaced forwardly from the end 16 of the base. This allows the base of one exercise chair to be moved downwardly over the seat of an underlying chair until the sides of the base rest on the rubber bumper pads 33 on the tapered upper components 32 of the leg structures 22 and 24 as best seen in FIGS. 4 and 5. As mentioned previously, however, in the operative position of the movable bar 36, it is positioned rearwardly or behind the front support leg structure 22 and is therefore in vertical alignment with the seating platform so that if one chair were moved downwardly over an underlying chair with its movable bar in the operative position of FIG. 1, the movable bar would engage the seating platform and prevent the upper chair from being lowered over the lower chair in a nested relationship. However, by pivoting the movable bar from the operative position of FIG. 1 to the storage position of FIG. 5, the movable bar is positioned forwardly of the seating platform and therefore will not restrict nesting of two exercise chairs. This can be clearly appreciated by reference to FIG. 5. Further, when the movable bar is in the storage position of FIG. 5, the foot rod 50 is pulled rearwardly by the coil springs 52 into engagement with the front support leg structure so that it too is not an obstruction to nesting of one exercise chair on an underlying chair.

As an alternative to the exercise chair shown in FIGS. 1-5, FIGS. 6-10 illustrate a second embodiment wherein like parts have been given like reference numerals with a prime suffix. In the second embodiment, a generally U-shaped base 12' having sides 14' and an end 16', support a seating platform 20' with a pair of upright generally inverted U-shaped support leg assemblies 22' and 24' having lower vertical components 30' and upwardly inwardly tapered upper components 32' with a top leg 28' being interconnected with the seating platform. An anchor bracket 34' for anchoring the rear ends of coil springs 52' is secured to the seating platform and/or the rear leg assembly 24' with the forward ends of the coil springs being secured to a flange 54' on a slide 56' movable along a stanchion 48' on a movable bar 36'. The free-end of the stanchion has a transverse foot rod 50' anchored thereon so that the foot rod can be pivoted about the movable support bar.

In this embodiment, however, the movable support bar 36' has fixed pins 64 (FIG. 9) axially extending from each end that are adapted to slide in sliding plates 66 secured on an inner face of each side 14' of the base 12'. The plates 66 have an elongated horizontal slot or track 68 therein that is downturned at each end to define detents 70 in which the pins 64 can be releasably positioned in the operative position of the movable bar of FIG. 6 and the storage position of FIG. 10. A rigidifying plate 72 is shown in this embodiment interconnecting the free ends of the sides 14' of the base which may or may not be used to establish and maintain the desired width of the chair but could be used in either embodiment of the invention.

Figure 6:
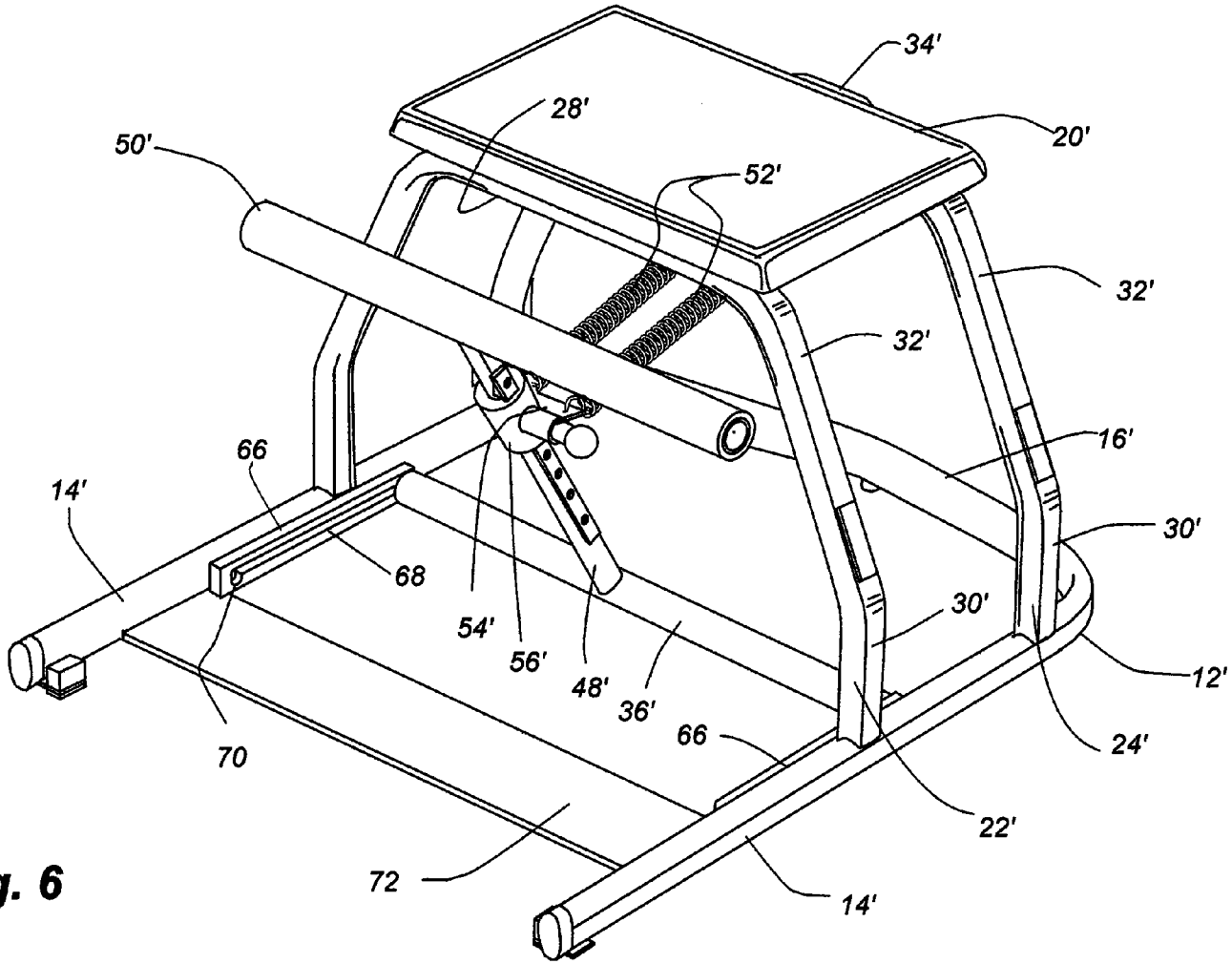
FIG. 6 is an isometric of a second embodiment of the exercise chair of the present invention with the support bar in its operative position.
Figures 7, 8, 9:
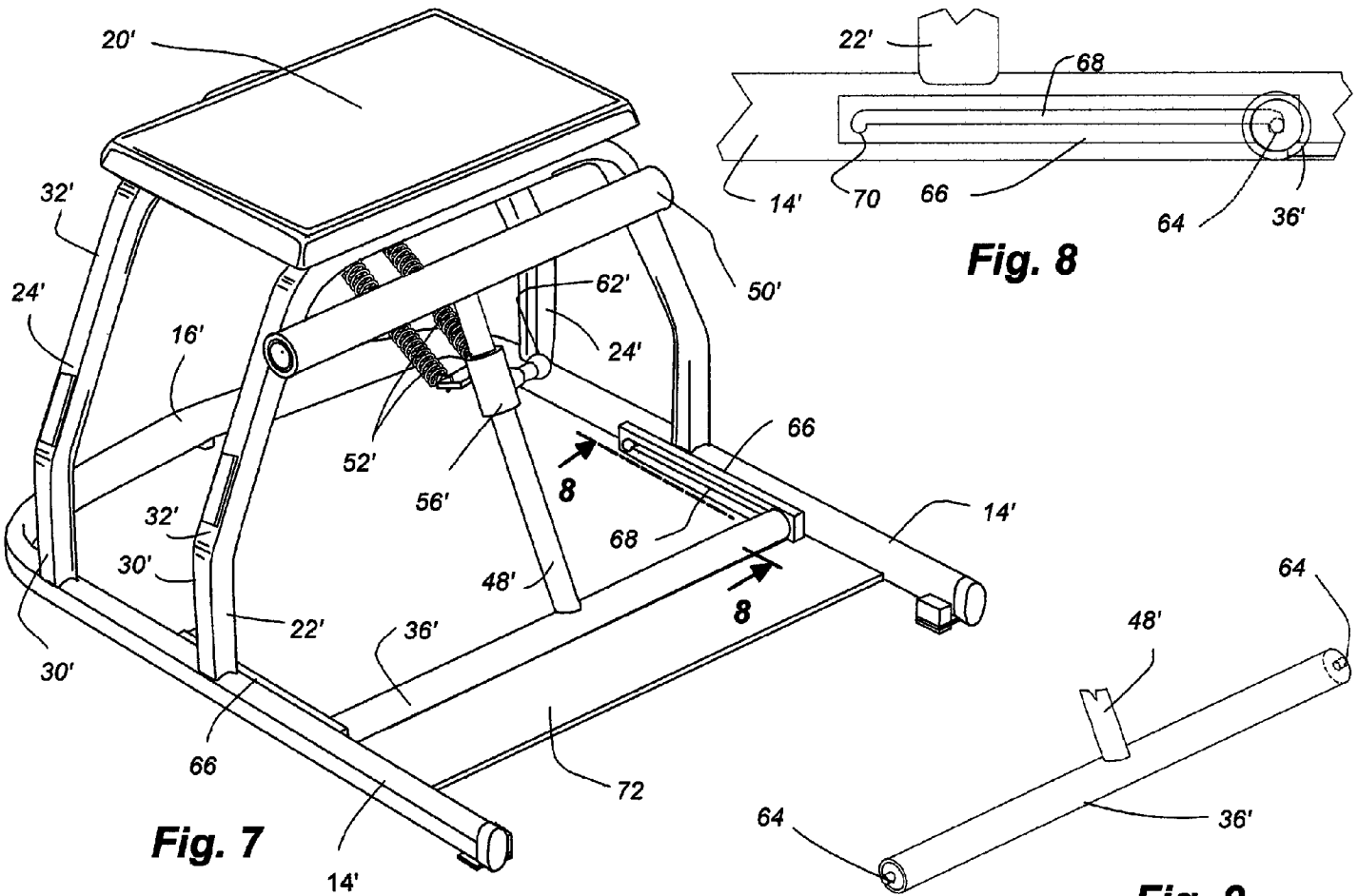
FIG. 7 is an isometric of the chair of FIG. 6 with the movable bar in its storage position.
FIG. 8 is an enlarged fragmentary section taken along the line 8-8 of FIG. 7.
FIG. 9 is a fragmentary isometric of the movable bar.
Figure 10:
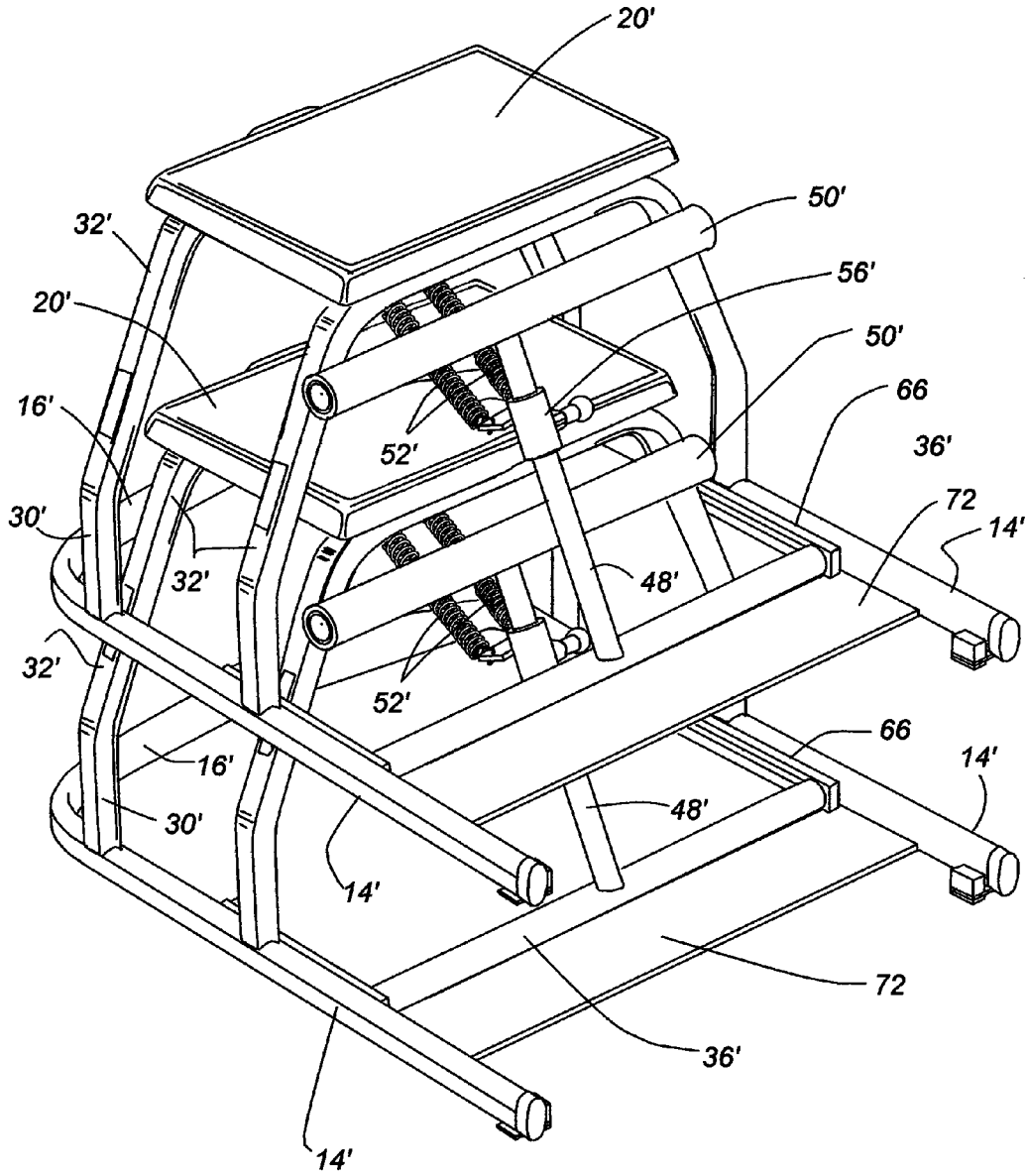
FIG. 10 is an isometric of two exercise chairs of the type shown in FIG. 6 in a nestably stacked position.

With the movable bar 36' positioned in its operative position of FIG. 6, it will be appreciated a user of the exercise chair seated on the seating platform 20' could place his feet on the foot rod 50' and reciprocally pivot the rod about the movable bar. When storing a plurality of chairs in a stacked and nested relationship as shown in FIG. 10, the movable bar is slid forwardly and releasably fixed in the detent 70 at the forward end of the slot 68 so that the movable bar is in front of the front support leg structure 22' and the foot rod is resting against the front of the front leg structure. In this position, as with the first embodiment, one chair can be moved downwardly over an underlying chair so the sides 14' of the base 12' move past the seating platform 20' and rest upon the tapered upper segment 32' of the support legs for the seating platform. With the movable bar positioned forwardly of the seat platform and the foot rod 50' tilted rearwardly into engagement with the front support leg structure, clearance is provided for the base 12' of one chair to fit down over the seating platform 20' and the foot rod 50' of an underlying chair until the sides of the base rest on the tapered upper segments of the support legs.

Figure 14:
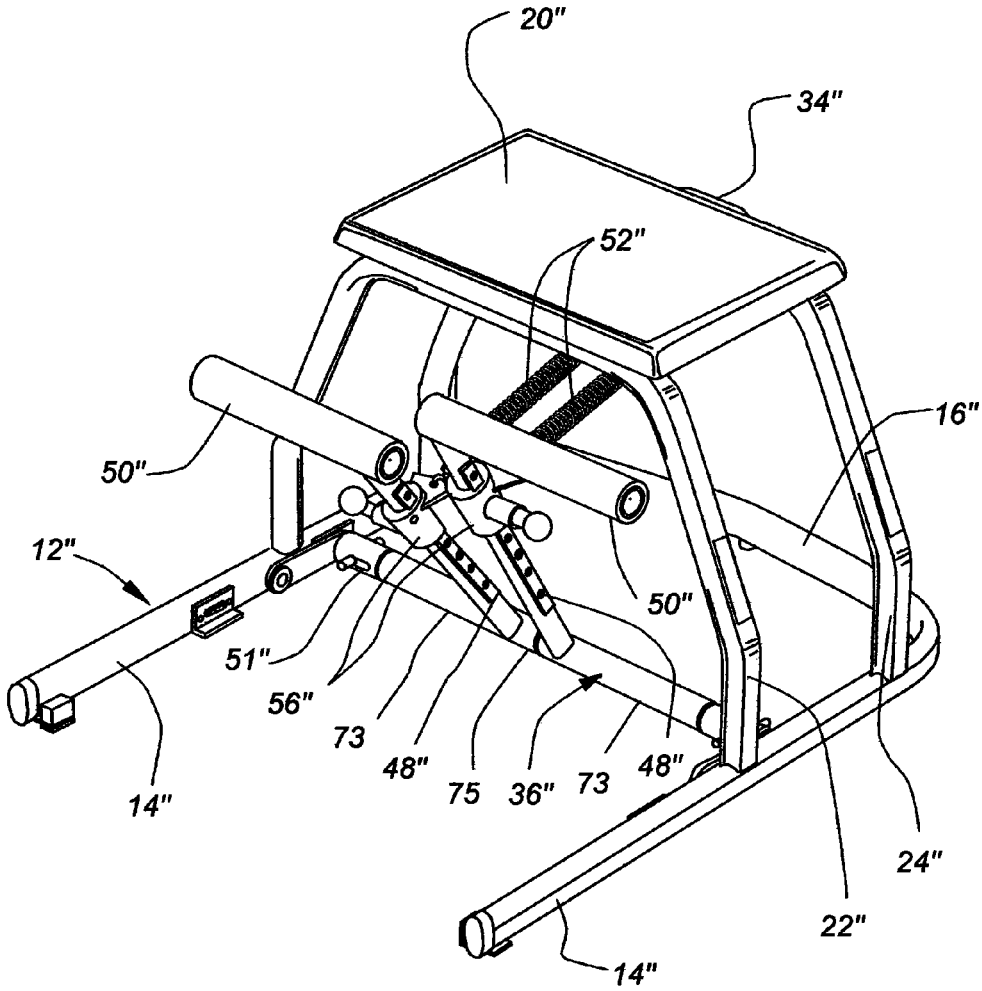
FIG. 14 is an isometric of still a further embodiment of the chair of the present invention.

In a further embodiment to that illustrated in FIGS. 1-5 and shown in FIG. 14, wherein like parts have been given like reference numerals with a double prime suffix, the exercise chair again has a base frame 12" having sides 14" and an end 16". A seating platform 20" is again mounted in an elevated position from the base by a pair of front 22" and rear 24" support leg structures with are generally inverted U-shaped in configuration. A movable transverse bar 36" in this embodiment of the chair instead of having one sleeve 71 includes two axially aligned but independently pivotal sleeves 73 that are separated and confined by flanged bushings 75 and mounted on a support tube 47". The sleeves 73 are held in position by the flanged bushings at opposite ends thereof. Each sleeve supports, on an inner end adjacent to the inner end of the other sleeve, a rigid stanchion 48" which supports on its outer distal end a rigid foot engagement rod 50". The foot engagement rods are separated so the feet engaging the foot rods can move independently of each other and with the foot rods pivoting about the support tube on which the associated sleeves are pivotally mounted. Each stanchion also has a slide 56" mounted thereon which is secured to a separate coil spring 52" whose opposite end is anchored to a mounting bracket 34" on a seat platform 20". With this embodiment of the invention, it will be seen that different exercises can be performed than those with the embodiment illustrated in FIGS. 1-5.

Figure 11:
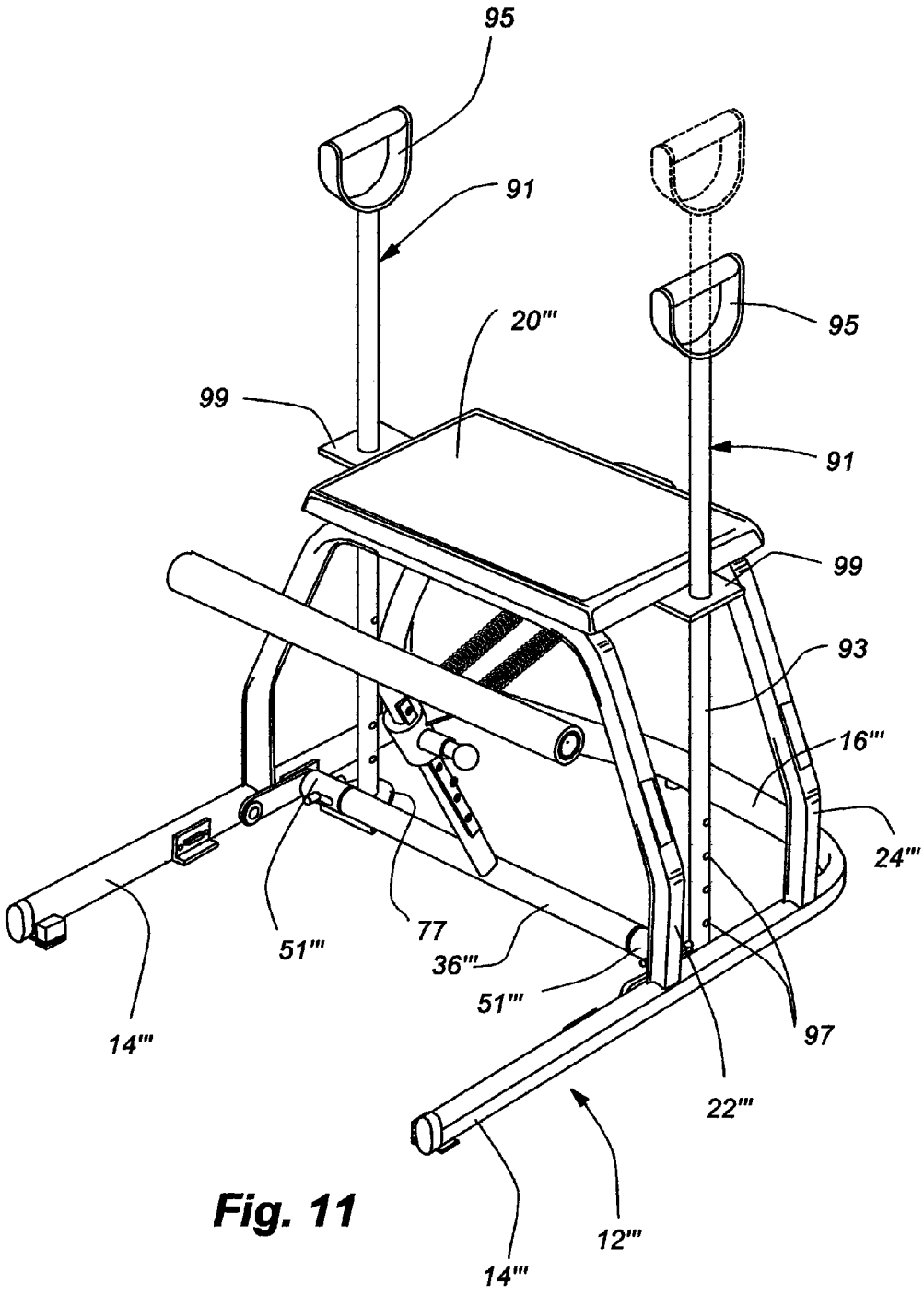
FIG. 11 is an isometric of an alternative to the embodiment of FIGS. 1-5.
Figure 13:
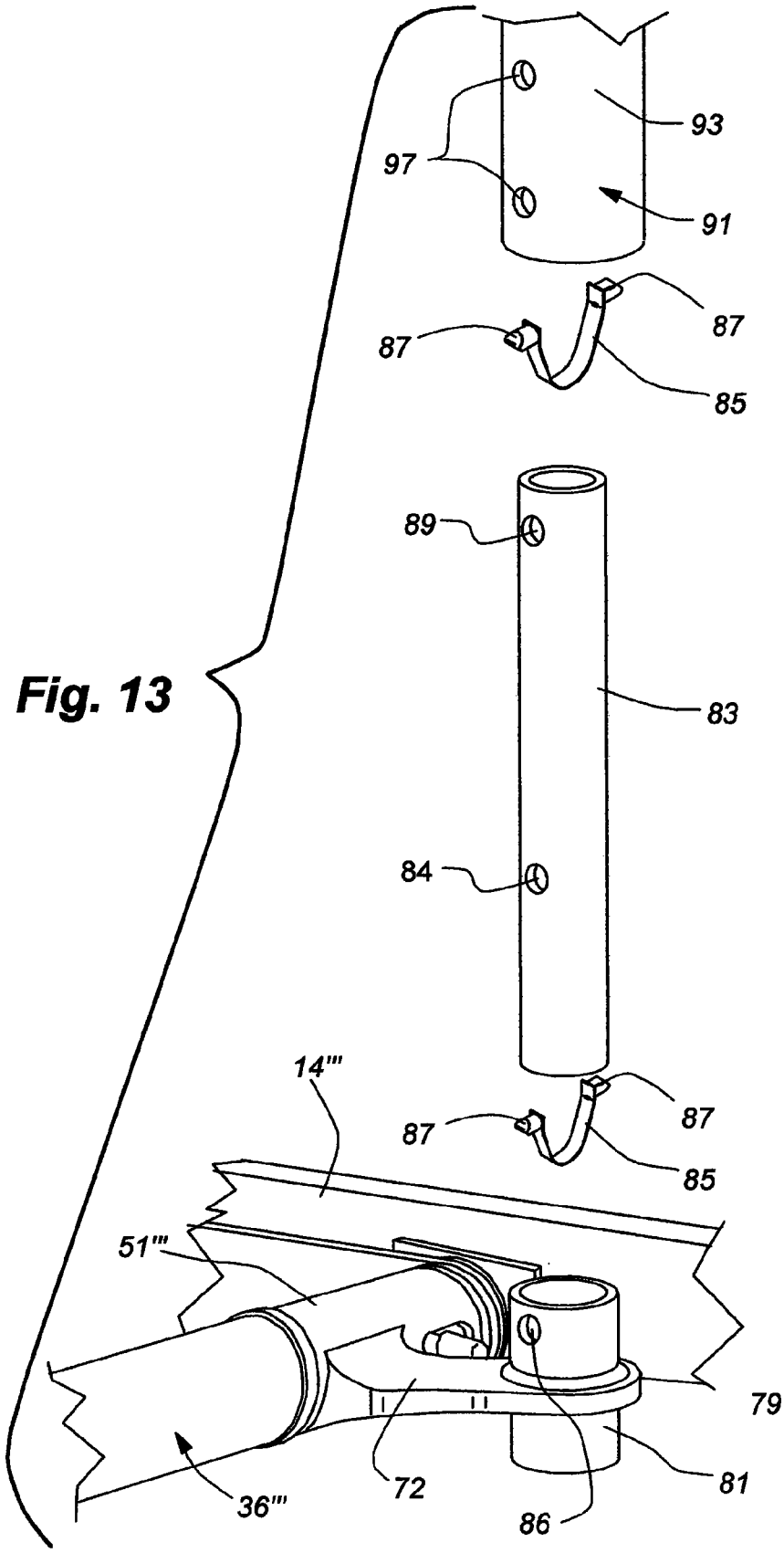
FIG. 13 is an enlarged exploded isometric of the lower end of the handles shown in FIG. 11.

In a still further embodiment of the invention from that illustrated in FIGS. 1-5 and shown in FIGS. 11 and 13, like parts have again been given like reference numerals but with a triple prime suffix. In this embodiment, the exercise chair again has a base frame 12'''; having sides 14''' and an end 16'''. A seating platform 20''' is again mounted in an elevated position from the base by a pair of front 22''' and rear 24''' support leg structures with are generally inverted U-shaped in configuration.

In this embodiment, the extension tubes 51''' have a rearwardly projecting bracket 72 welded or otherwise secured thereto so as to form a radial extension with the bracket rigidly supporting a vertical elongated hollow tube 81 that is welded to the bracket and extends upwardly and downwardly from the bracket. A support tube 83 is slidably and removably received in the tube 81 so as to project downwardly therefrom to define a leg for engagement with a support surface for the chair. The support tube 83 has a pair of diametrically opposed holes 89 at the top thereof and another pair 84 spaced slightly from the bottom thereof. A resilient spring lock 85 is seated in the support tube adjacent to each pair of holes 84 and 89 with the spring locks having outwardly directed pins 87 projecting out of the adjacent pair of holes. The hollow tube 81 also has a pair of diametrically opposed holes 86 which can be aligned with the holes 84 and pins 87 of the lower spring lock to thereby releasably connect the support tube 83 to the hollow tube 81.

There is a handle 91 at each side of the chair comprised of an elongated hollow tube 93 of slightly larger internal diameter than the external diameter of the hollow support tube 83 and having a hand grip 95 on its upper end. The hollow lower end of the elongated tube 93 has a plurality of vertically aligned and diametrically opposed holes 97 therein for releasable receipt of the pins on the upper spring lock so that by depressing the pins on the spring lock, the handle tube can be raised or lowered relative to the hollow support tube 83 to any desired degree. The handles also slidably pass through lateral extension brackets 99 on opposite sides of the seating platform 20''' to positively but slidably position the handles. The handles, of course, can be completely removed by lifting the handles off the hollow support tubes 83 after depressing the spring lock. The support tubes 83, with or without the handles connected thereto, can be removed from the hollow tubes 81 in the same manner. This leaves the chair in a condition where it can be stacked with other similar chairs and the handles can be stored separately. The handles and support tubes 83 would have to be removed in order to allow the movable bar 36''' to be shifted or pivoted from its use position shown in FIG. 1 to its storage position.

As will be appreciated from the above, an exercise chair has been described for accommodating physical exercises with the chairs being stackable to conserve space during storage. Even though the chairs can be stacked, with a very simple one-step move, they can be re-positioned for use in an exercise. It should also be noted features from the various embodiments can be interchanged or combined. For example, the handles shown in FIG. 11 could be incorporated into the split foot bar embodiment of FIG. 14 and either or both the handles and the split foot bar could be used with either system for moving the movable bar 36 between operative and storage positions shown in FIGS. 1 and 6.

FIGS. 15-29 show three additional embodiments of the present invention where the chair is foldable into a compact unit to conserve space during storage and can be easily unfolded into a rigid use position for performing any of the exercises of the stackable chair embodiments disclosed in FIGS. 1-14.

Looking first at FIGS. 15-20, an embodiment of a longitudinally foldable exercise chair is illustrated which includes a seating platform 100 supported on a generally U-shaped base frame 102 by a pair of pivotal side legs 104 and a pivotal rear leg 106. A pivotal transverse bar 108 is provided supporting a stanchion 110 that is rigidly connected to the transverse bar and a foot rod 112 mounted on the distal end of the stanchion. A sleeve 114 is slidably mounted on the stanchion for anchoring one end of a coil spring 116 whose opposite end is connected to a bracket 118 along the rear edge of the seating platform.

More specifically, the base frame 102 is a tubular frame of generally U-shaped configuration so as to have side components 120 and an interconnecting rear 122 component with the frame opening forwardly. Pivot brackets 124 are welded or otherwise secured to the top surface of the sides at an intermediate location along their length to pivotally support the lower ends of the side support legs 104 which in the use position of FIGS. 15 and 16 extend substantially vertically and are connected to the pivot bracket with a pivot pin 126 that extends transversely to the base frame. The upper end of each side support leg is pivotally connected to a pivot bracket 128 that extends downwardly from a forward corner of the seating platform 100 and again the connection is made with a pivot pin 130 that extends transversely to the base frame so that the side support legs are pivotally connected to both the seating platform and the base frame.

The rear support leg 106 interconnecting the rear component 122 of the base frame 102 with the seating platform 100 is also pivotally connected to the base frame with a pivot bracket 132 that is welded or otherwise connected to the top surface of the rear component. A transversely extending pivot pin 134 accommodates the pivotal connection of the lower end of the rear support leg to the base frame. The rear support leg is a telescoping leg having an outer sleeve 136 which is pivotally connected to the bracket on the base frame and an inner tube 138 that telescopes within the outer sleeve. The inner tube has a generally cylindrical head 140 on its upper end which pivotally fits between a pair of ears 142 on the support bracket 118 along the rear edge of the seating platform and has a passage therethrough to receive a transversely extending pivot pin 144 so the inner tube is pivotally connected to the bracket on the seating platform.

Figure 15:
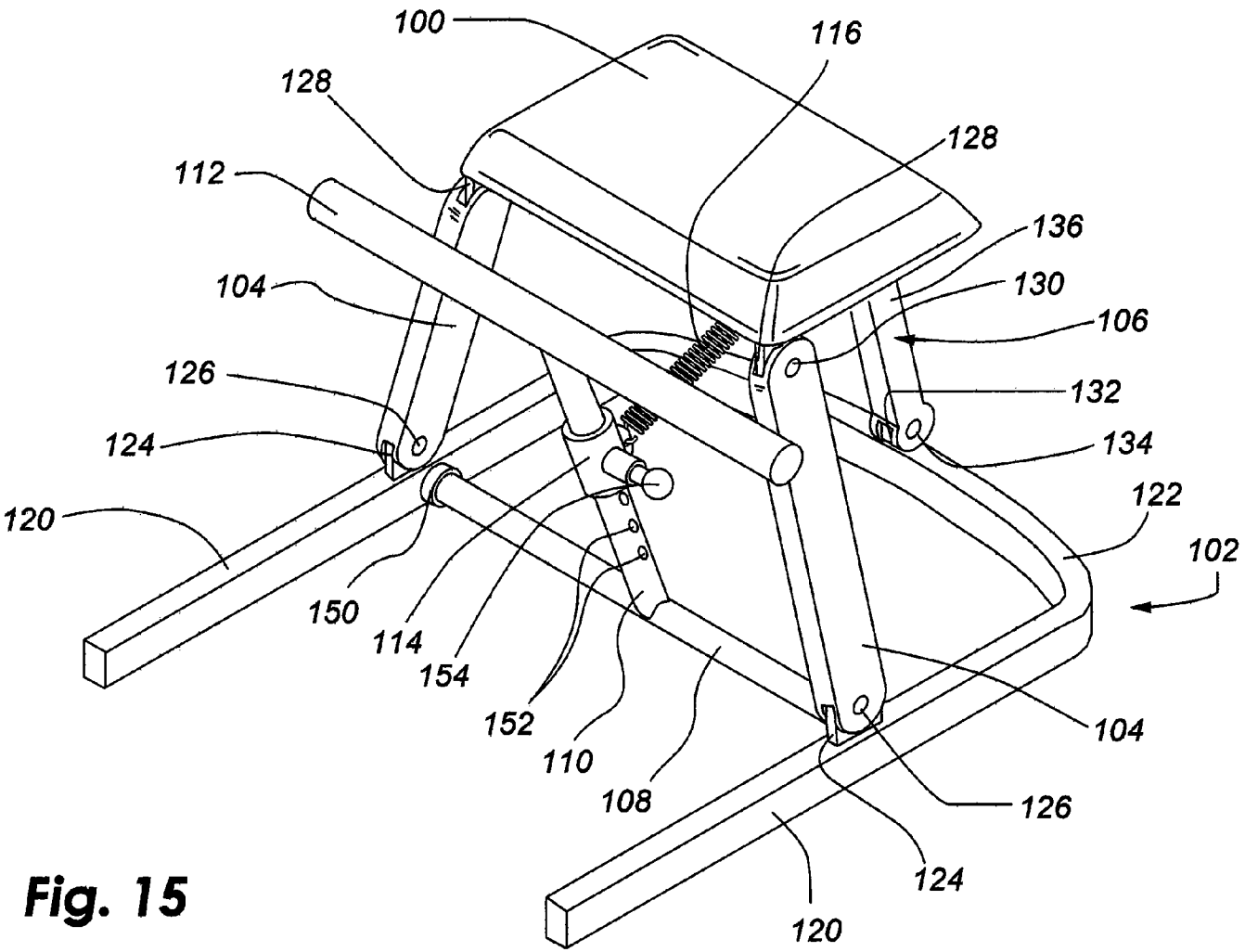
FIG. 15 is an isometric looking downwardly and rearwardly at another alternative embodiment of the chair of the present invention where the chair is foldable longitudinally of the base.
Figure 16:
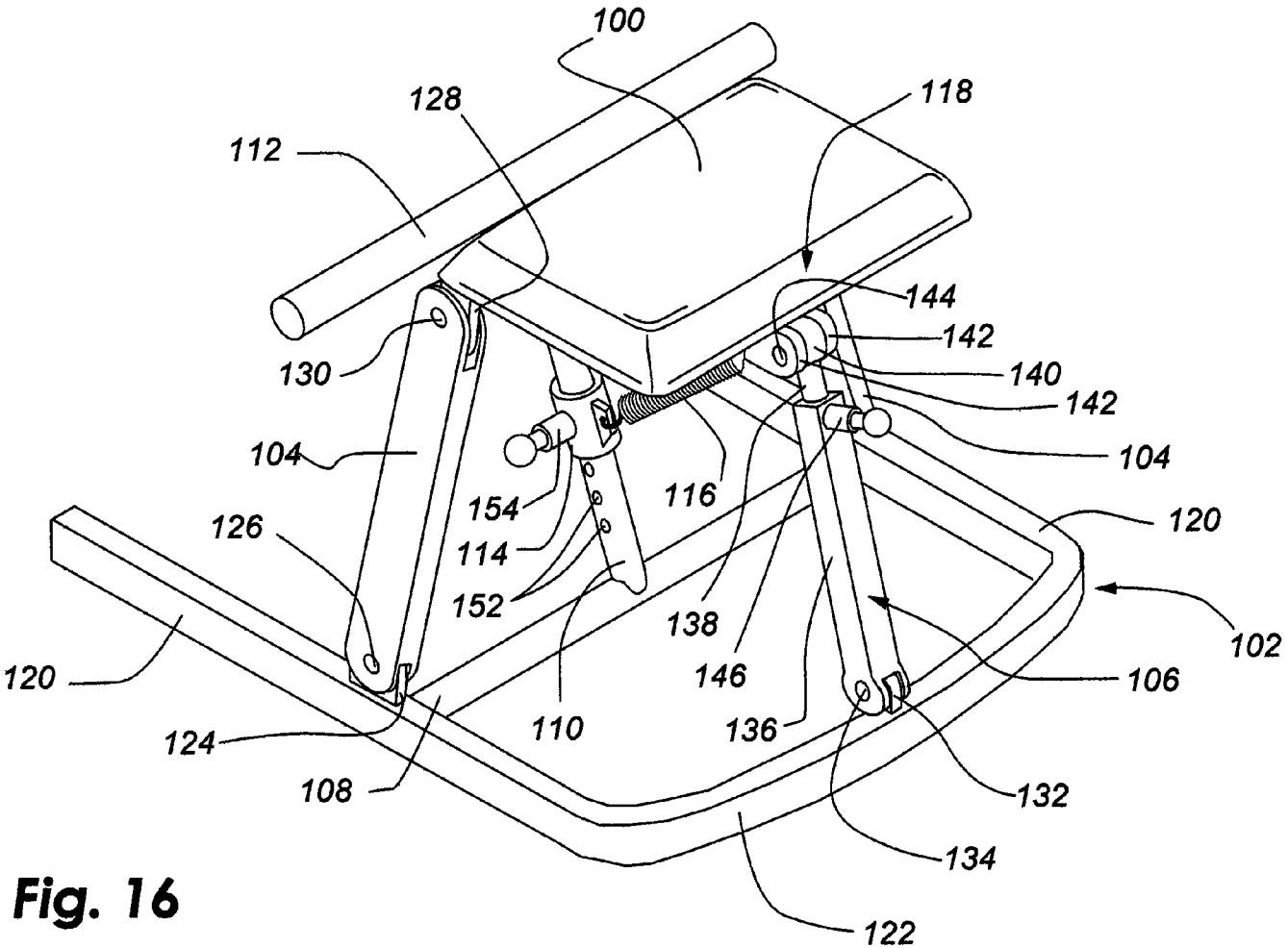
FIG. 16 is an isometric similar to FIG. 15 looking downwardly and forwardly at the rear of the chair.
Figure 18:
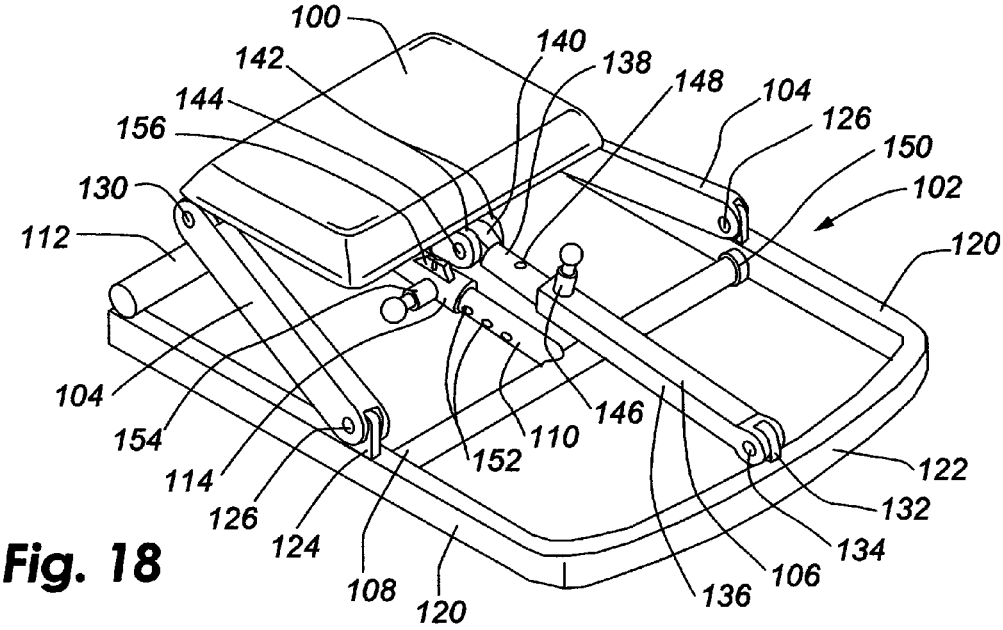
FIG. 18 is an isometric similar to FIG. 17 with the chair fully folded.
Figure 17:
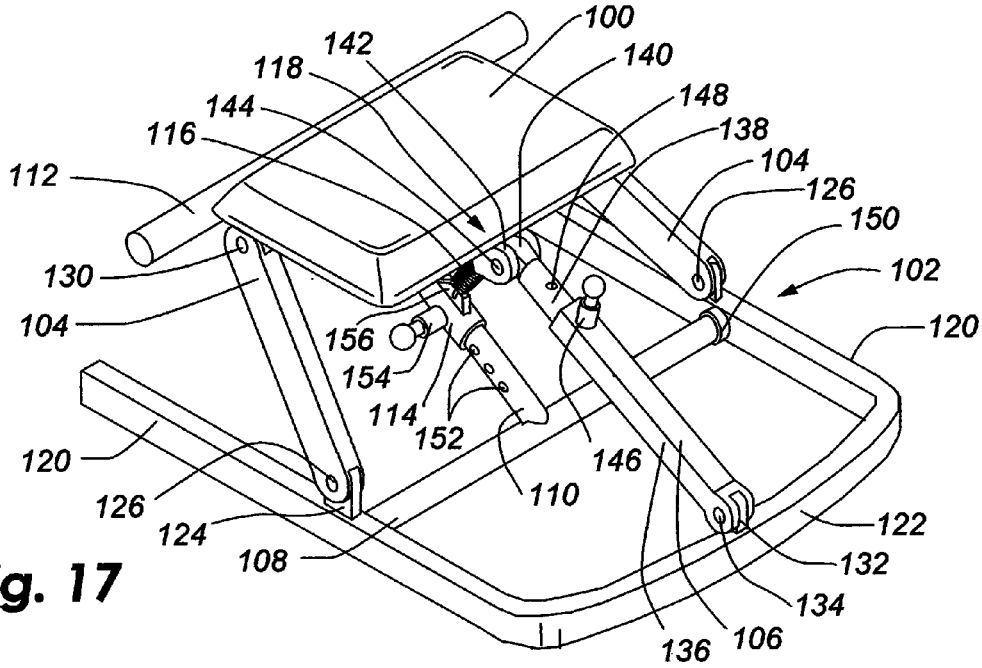
FIG. 17 is an isometric similar to FIG. 16 with the chair partially folded.

A conventional spring biased pull pin 146 mounted at the upper end of the outer sleeve 136 secures the rear support leg 106 in the extended position of FIGS. 15 and 16. The pull pin has a plunger (to be described later) which is biased in an inward or extended direction so the plunger of the pull pin is biased into a hole 148 (FIGS. 17 and 18) in the inner tube 138 of the rear support leg in its normally inwardly biased position to lock the inner tube in a fixed axial position relative to the outer sleeve as shown in FIGS. 15 and 16. By pulling or retracting the plunger outwardly against the bias of the spring, the plunger is pulled out of the hole 148 in the inner tube allowing the inner tube to slide axially relative to the outer sleeve, which permits the seating platform to pivot as shown in FIGS. 17 and 18 along with the side support legs 104 into a folded position of the chair shown in FIG. 18. The inner tube could have a second hole provided therein (which is not seen) into which the plunger can be received when the chair is folded as shown in FIG. 18. This would hold the chair in the folded position to facilitate convenient transportation of the folded chair.

Figure 19:
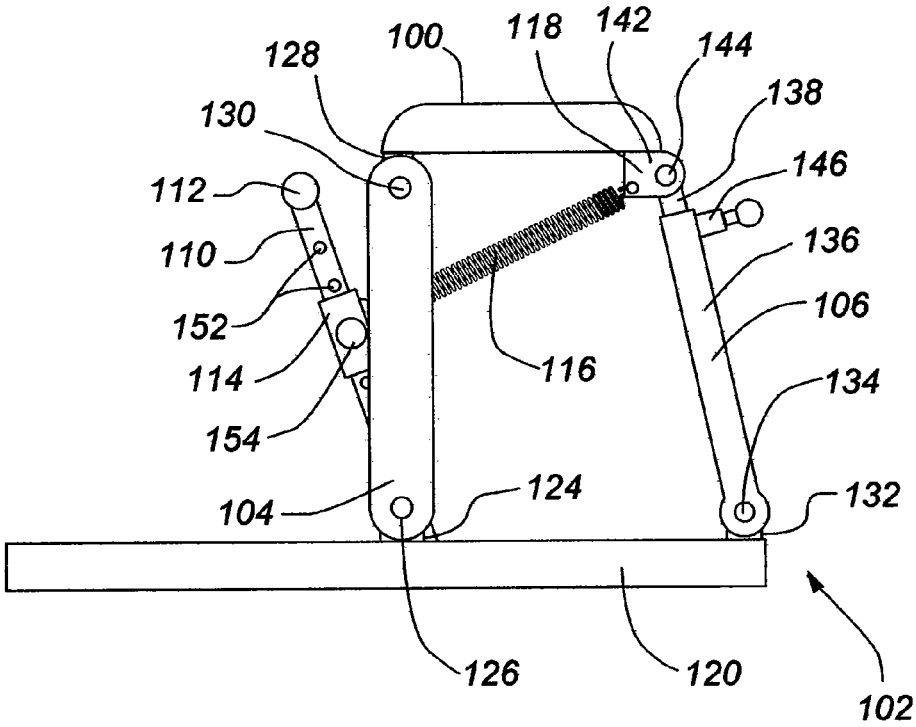
FIG. 19 is a left side elevation of the chair as shown in FIG. 15.
Figure 20:
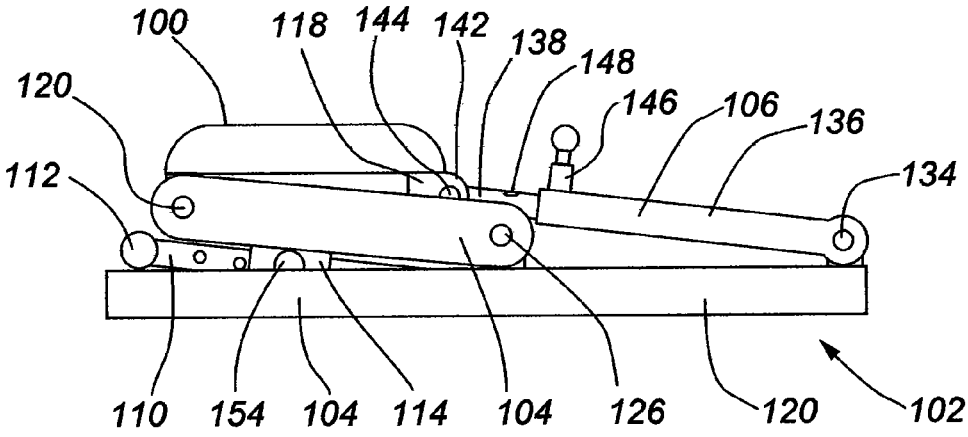
FIG. 20 is a left side elevation of the chair as shown in FIG. 18.

The transverse bar 108 can be a solid bar or hollow tube which is pivotally supported at its opposite ends in bearings 150 anchored to an inner surface of the side frame components 120 of the base frame 102. The transverse bar is therefore free to pivot about its longitudinal axis so the stanchion 110 is free to pivot in an arc about the transverse bar. As in previously described embodiments, the stanchion is provided with a plurality of transverse holes 152 along its length which are alignable with a pull pin 154 of the type previously described which is biased inwardly and mounted on the sleeve 114 that is slidable along the length of the stanchion. The sleeve can therefore be positively positioned at any desired position along the length of the stanchion to vary the leverage provided by the stanchion and thus the resistance to movement of the foot rod for exercise purposes. The sleeve includes an anchor bracket 156 for one end of the coil spring 116 with the opposite end of the coil spring being secured (as shown in FIG. 19) to the bracket 118 at the rear edge of the seating platform 100 to which the rear support leg 106 is mounted.

It will be appreciated that movement of the seating platform 100 between the operative use position of FIGS. 15 and 16 and the folded position of FIG. 18 permits not only folding movement of the seating platform relative to the base but a following pivotal movement of the foot rod 112 and stanchion 110 so that in the folded position of the chair shown in FIG.

18, all component parts of the chair are in a compact, relatively shallow relationship which can be easily stacked or stored in a small amount of space. Of course, to move the chair into a use position from the folded position of FIG. 18, it is only necessary to release the pull pin 146 on the rear support leg 106 (if necessary) and raise the seating platform until the plunger of the pull pin snaps into the upper hole 148 in the inner tube 138 to retain the seating platform in its elevated use position relative to the base frame.

Referring next to FIGS. 21-25, a second embodiment of a foldable exercise chair is illustrated with this embodiment having the chair fold laterally relative to the base frame rather than longitudinally as in the embodiment of FIGS. 15-20.

Figure 21:
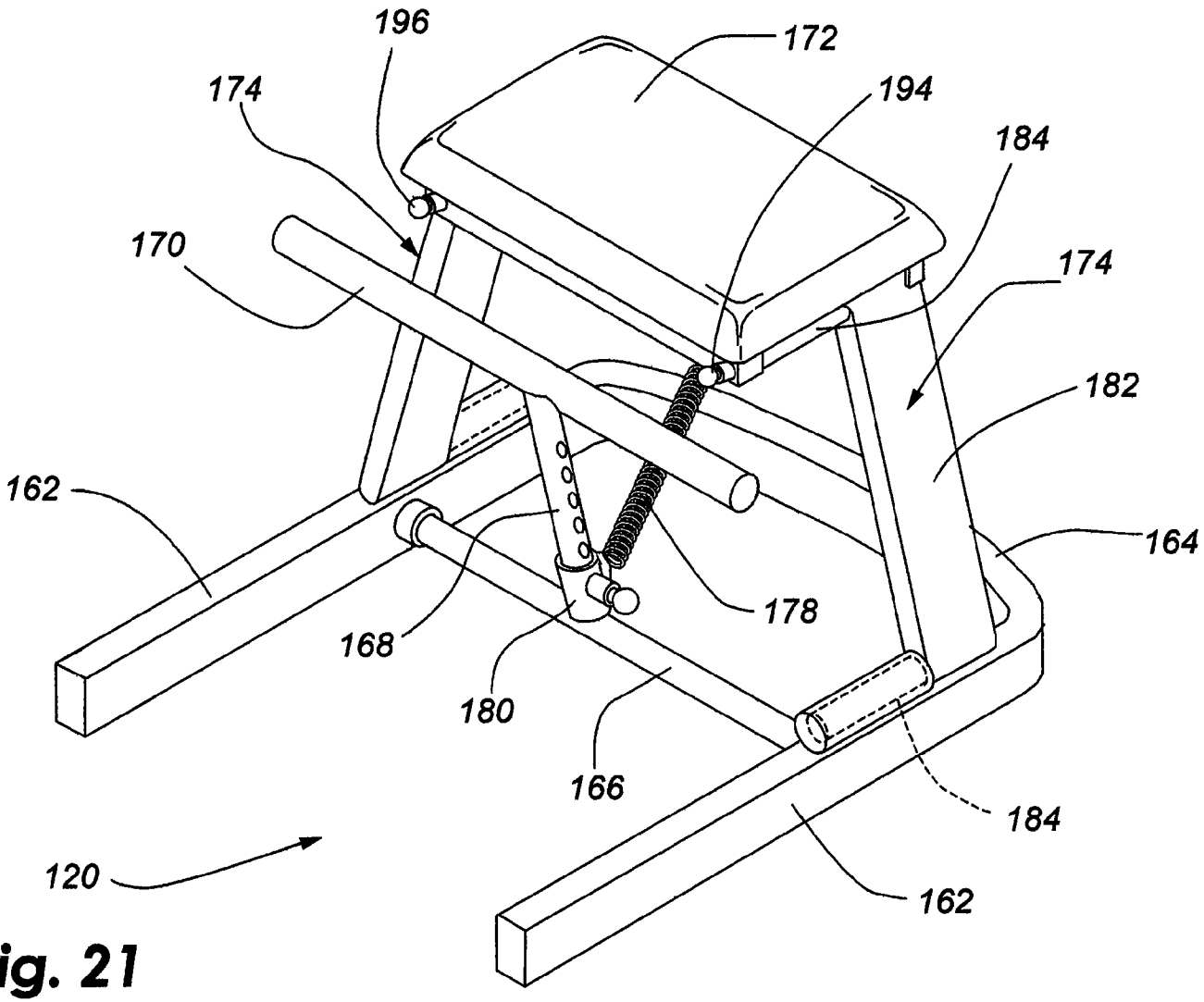
FIG. 21 is an isometric looking downwardly and rearwardly at another embodiment of the chair of the present invention where it is foldable laterally.

Looking first at FIG. 21, the chair can be seen to include a generally U-shaped base frame 160 having sides 162 and an interconnecting rear 164 element and a transverse bar 166 with interconnected stanchion 168 and foot rod 170 identical to that of the embodiment of FIGS. 15-20. A seating platform 172 is supported on its opposite sides by pivotal support legs 174 and the rear edge of the seating platform has a bracket 176 for anchoring the upper end of a coil spring 178 whose opposite end is secured to a slide 180 on the stanchion.

Figure 22:
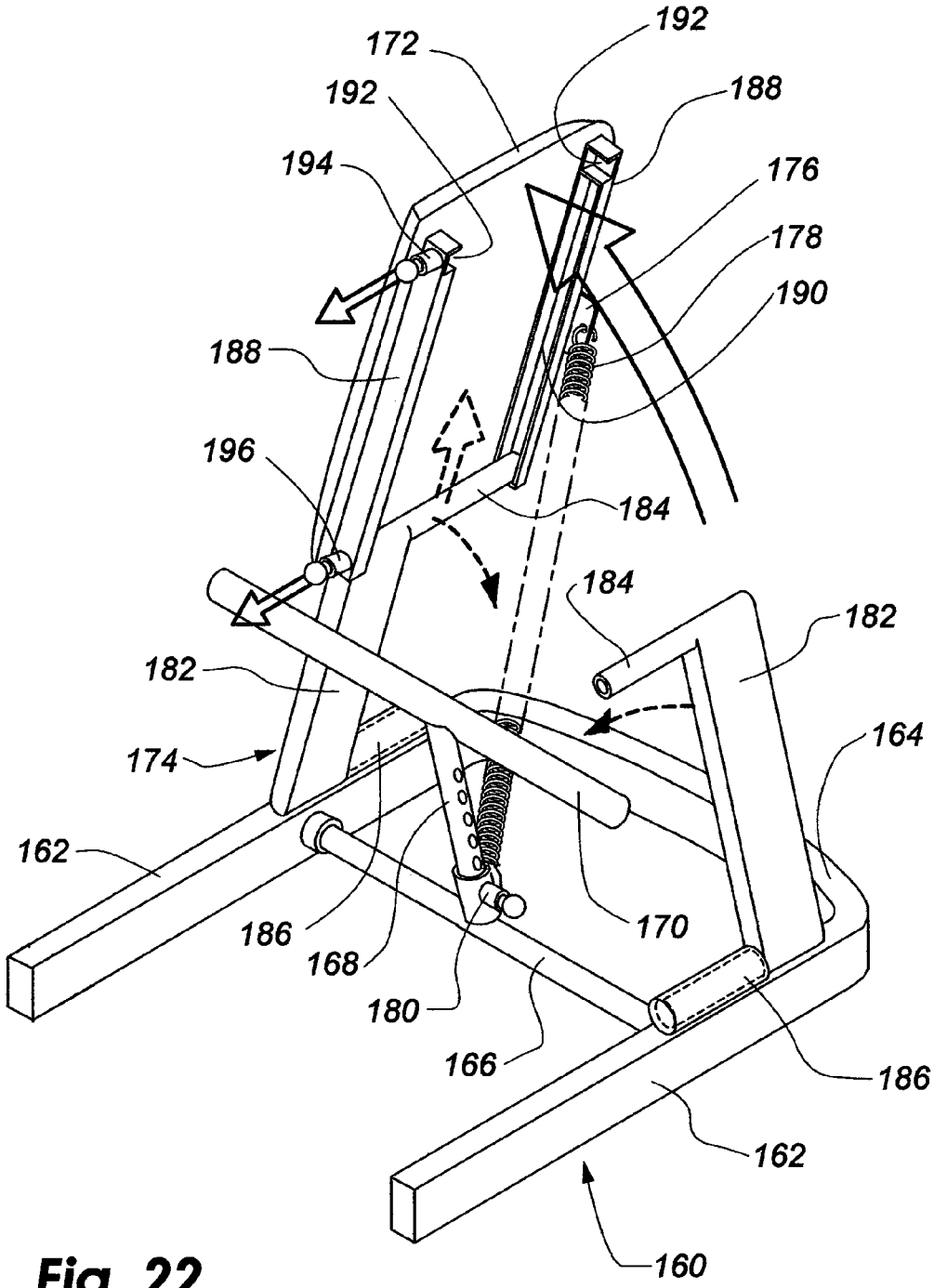
FIG. 22 is an isometric similar to FIG. 21 with the chair partially folded.
Figure 24:
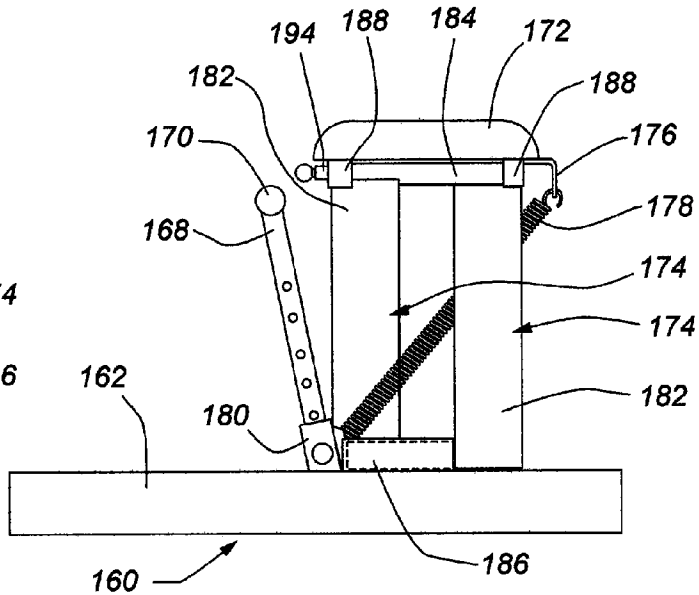
FIG. 24 is a left side elevation of the chair of FIG. 21.

Looking next at FIG. 22, the side support legs 174 are seen to be identical except mounted in a reverse direction with each leg including a generally rectangular plate-like main body portion 182 with horizontal parallel tubular extension components 184 extending transversely of the main body from opposite ends thereof. The tubular extension at the bottom of each side support leg is pivotally received in a tubular pivot bracket 186 welded or otherwise secured to the top of a side component 162 of the base frame so that the associated leg can pivot about the lower tubular component thereof which extends longitudinally of the base frame. The tubular component 184 of each leg 174 at the top thereof is adapted to cooperate with a pair of identical, confronting parallel track members 188 supported on the underside of the seating platform 172. Each track member is identical with one track member extending transversely of the chair along a front edge of the seating platform and the other along a rear edge. Each track member has an elongated longitudinal groove 190 extending along the length of the track member which opens toward the other track member. The groove 190 extends from the left side of the chair toward the right side of the chair where it terminates at a short transverse groove 192 at the right side of the chair as viewed in FIG. 22. The short grooves of the track members open toward the other track member and downwardly when the seating platform is horizontal and can be received on the upper tubular component 184 of the right support leg when the support leg is pivoted upwardly as shown in FIG. 22 and the seat is lowered into a horizontal orientation as shown in FIG. 21. The leg on the right side as viewed in FIG. 22 can then be secured in the short groove with a pull pin 194 of the type previously described in connection with FIGS. 15-20 that is mounted on the track member so its plunger is receivable in the open end of the upper tubular component 184 of the support leg that faces forwardly of the chair. In other words, when the right support leg as viewed in FIG. 22 is elevated and the seating platform is lowered into a horizontal orientation, the pull pin 194 in the front track member associated with the short groove can be pulled outwardly or retracted to allow the upper tubular component of the right side support leg to be received in the short groove and then allowed to extend under the bias of the spring so the plunger is received in the open end of the upper tubular component to releasably connect the seating platform to the right support leg.

The upper tubular component 184 of the side leg 174 on the left side of the chair as viewed in FIG. 22 faces the opposite direction of that on the right side so that the rectangular main body 182 of the leg is along the front edge of the seating platform 172. A cylindrical passage through the upper tubular component of the left leg, however, opens through the front edge of the main body of the left support leg so that an identical pull pin 196 to that previously described, which is mounted along the left edge of the front track member 188 and in communication with the long groove 190, can be used to secure the front track to the left side support leg. It will be appreciated that the rear end of the upper component of the left side support leg is slidably received in the long groove 190 along the rear edge of the seating platform for folding purposes.

Figure 25:
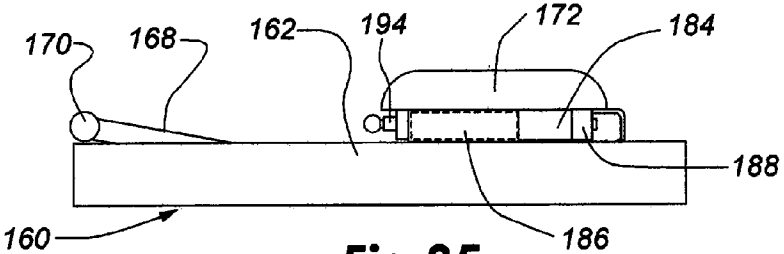
FIG. 25 is a left side elevation of the chair of FIG. 21 in a fully folded position.
Figure 23:
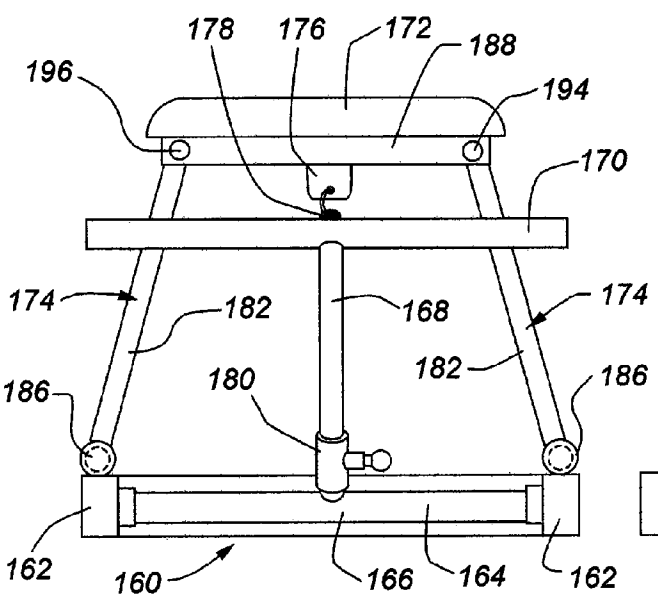
FIG. 23 is a front elevation of the chair of FIG. 21.

In folding the chair from the erected use position illustrated in FIG. 21 to the folded position shown in FIG. 25, the pull pin 194 associated with the right support leg 174 component as viewed in FIG. 22 is retracted so the seating platform can be pivoted upwardly about the upper tubular component 184 of the left side support leg as shown in FIG. 22. When the seating platform is aligned with the main body 182 of the left side support leg, the pull pin 196 associated with the left side support leg is pulled outwardly or retracted, which allows the seating platform to slide downwardly with the upper component 184 of the left side support leg sliding within the long grooves 190 of the track members 188 until the seating platform is substantially coplanar with the left side support leg in a position that is not illustrated. Once the seating platform has been slid along the left side leg until it is substantially coplanar with the left side leg, the two side support legs 174 can be folded downwardly adjacent to the base frame 160 as shown in FIG. 25. Of course when the side support legs are being folded downwardly, the stanchion 168 and foot rod 170 are also allowed to fold downwardly into adjacent relationship with the base frame as can be seen in FIG. 25.

Of course, to re-erect or unfold the chair into its use position of FIG. 21, a reverse procedure is followed by pivoting the side support legs upwardly, sliding the seat platform upwardly until the pull pin associated with the left side support leg snaps into the open front end of the upper tubular component 184 and then pivoting the seating platform downwardly until the pull pin associated with the right support leg can be snapped into the open front end of the upper right tubular component.

Referring to FIGS. 26-29, a third embodiment of a folding exercise chair is illustrated, which is again foldable laterally rather than longitudinally of the base frame. The exercise chair can again be seen to include a generally U-shaped base frame 200 having side elements 202 and a rear interconnecting element 204 along with a pivotal transverse bar 206 having its opposite ends pivotally mounted in bearings 208 secured to the sides 202 of the base frame. The transverse bar again supports a stanchion 210 and foot rod 212 and a slidable sleeve 214 along the length of the stanchion which is connected to a bracket (not seen) on the rear edge of the seating platform with a coil spring 216.

Figure 26:
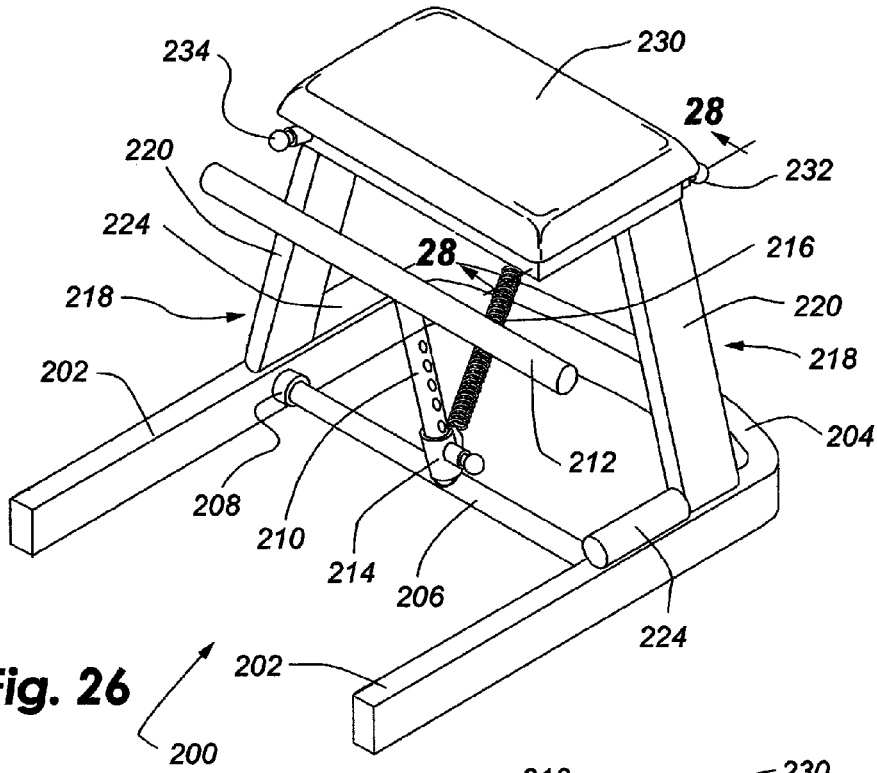
FIG. 26 is an isometric looking downwardly and rearwardly at a third embodiment of a foldable chair in accordance with the present invention.

In this embodiment of the exercise chair, side legs 218 have a flat generally rectangular main body component 220 and a tubular component (not seen) along a lower end thereof extending horizontally in only one direction. The lower tubular component associated with the right support leg (as viewed in FIGS. 26 and 27) extends forwardly from the main body while the tubular component of the left support leg extends rearwardly. The lower tubular components are pivotally received in pivot brackets 224 secured to the top of the side frame elements 202 which extend longitudinally of the chair. The upper end of each side support leg has a centered tubular component 226 secured to the top edge of the main body 220 of the support leg as best seen in FIG. 28 and this tubular component, which extends in both directions from the main body but is only slightly longer than the width of the main body, is confined and adapted to slide along confronting channel members 228 extending transversely along the lower surface of a seating platform 230. The channel members therefore define tracks along which the upper tubular components 226 of the side legs can slide when the chair is being folded or unfolded. The rearmost channel member has a pull pin 232 of the type described previously mounted thereon adjacent to the right end of the seating platform as viewed in FIGS. 26 and 27, while a similar pull pin 234 is mounted on the forwardmost channel member adjacent to the left end of the seating platform. The pull pins are adapted to cooperate with the upper tubular components 226 of an associated side support leg to hold the side support legs in a fixed position relative to the seating platform adjacent one end thereof as shown in FIG. 26 when the chair is fully erected in a use position.

Figure 27:
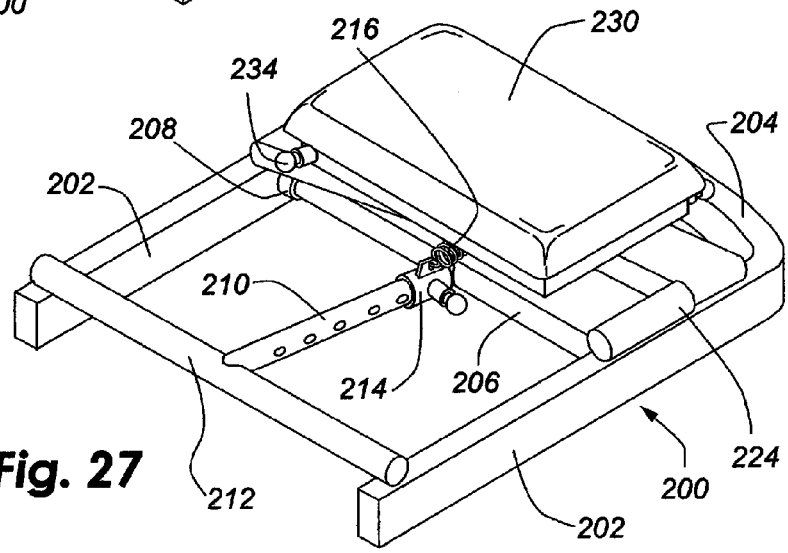
FIG. 27 is an isometric of the chair of FIG. 26 in a fully folded position.
Figure 28:
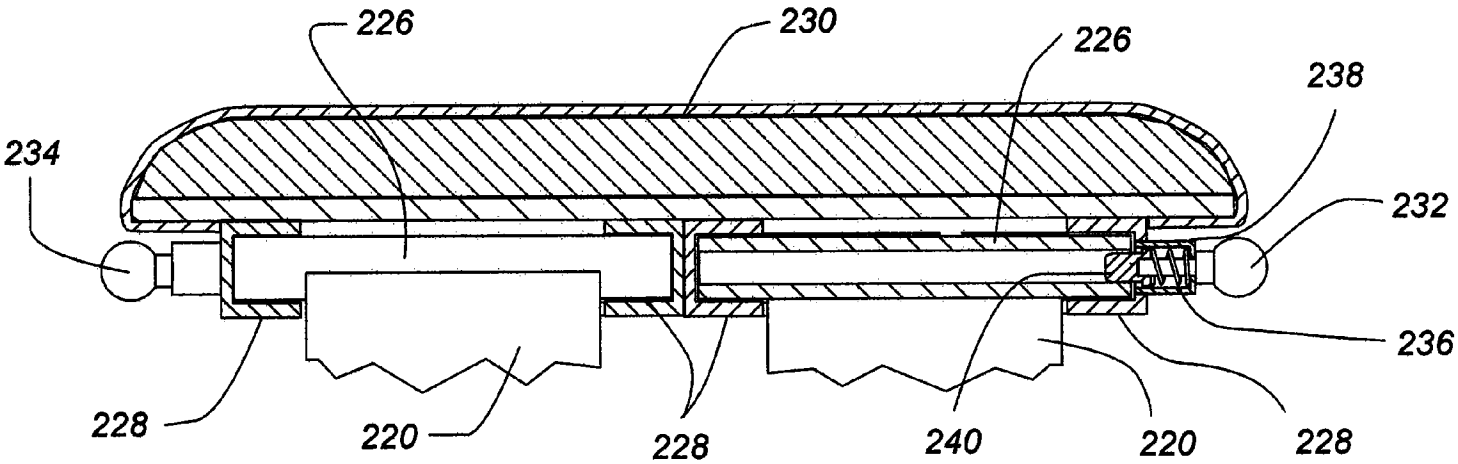
FIG. 28 is an enlarged fragmentary section taken along line 28-28 of FIG. 26.

In order to fold the chair into the folded position of FIG. 27, the pull pins are retracted from the tubular open ends of the tubular components 226 of the side support legs allowing the support legs to slide along the length of the associated channel members toward the opposite end of the seating platform, which of course allows the entire seating platform to collapse downwardly into the folded position of FIG. 27. It will also be appreciated that the foot rod 212 and the stanchion 210 on which it is mounted can also be folded during folding movement of the seating platform.

Figure 29:
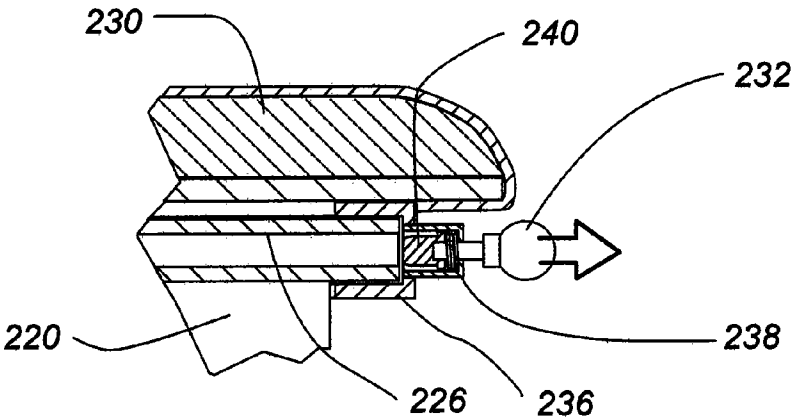
FIG. 29 is a fragmentary section showing the pull pin illustrated in FIG. 28 in a retracted position.

The pull pin referenced in the three embodiments of the folding chair can be seen in FIGS. 28 and 29 to include a cylindrical cavity 236 that encloses a coil spring 238 and through which a pull pin plunger 240 can slide axially either against the bias of the spring when it is pulled outwardly or with the bias of the spring when it is allowed to slide inwardly relative to the cavity. The inner end of the plunger projects beyond the cavity so it can be received in a respective component of the chair depending upon the embodiment in which the pull pin is utilized.

It will be appreciated from the above that the three embodiments of the folding exercise chair are easily movable from an extended use position to a folded storage position merely by operating one or two pull pins. It is further appreciated that when the chair is folded, it is folded into a relatively flat, compact condition which occupies relatively minimal space for storage and convenient transport of the chairs.

Although the present invention has been described with a certain degree of particularity, it is understood the disclosure has been made by way of example, and changes in detail or structure may be made without departing from the spirit of the invention as defined in the appended claims.

What is claimed is:

1. A foldable exercise chair, comprising:

a base, a seating platform, supporting legs, pivotally moveable between an elevated use position and a folded storage position interconnected to said seating platform and pivotally interconnected to said base for pivotal movement of said seating platform between said elevated use position and said folded storage position wherein said seating platform is adjacent to said base, a releasable lock associated with said legs for releasably retaining said legs in said elevated position, and for selectively permitting said legs to be moved into said folded storage position, an elongated traverse bar pivotally mounted on said base for movement about a longitudinal axis, a foot-engaging member operably secured to said traverse bar for pivotal movement with said traverse bar, and resilient means for biasing said foot-engagement member in one pivotal direction.

2. The chair of claim 1 wherein said base has sides and a rear and defines a longitudinal dimension parallel to said sides, and wherein said legs are pivotal about axes perpendicular to said longitudinal dimension.

3. The chair of claim 1 wherein said base has sides and a rear and defines a longitudinal dimension parallel to said sides, and wherein said legs are pivotal about axes perpendicular to said longitudinal dimension.

4. The chair of claim 2 wherein there are two of said legs positioned adjacent to said sides of the base and a third leg positioned adjacent to said rear of the base.

5. The chair of claim 4 wherein said releasable lock is incorporated into said leg at the rear of said base.

6. The chair of claim 5 wherein the leg at the rear of said base is telescopic and movable between extended and retracted positions, and wherein said lock selectively prevents the leg at the rear from telescopic movement.

7. The chair of claim 6 wherein extension of said leg at the rear of the base permits all legs to pivot into the folded storage position along with the seating platform and retention of said leg at the rear of the base in said retracted position by said releasable lock selectively maintains the legs and the seating platform in the elevated use position.

8. The chair of claim 3 wherein there are only two supporting legs and they are connected to said base at said sides.

9. The chair of claim 8 wherein one of said legs is releasably connected to said seating platform.

10. The chair of claim 9 wherein the other of said legs is slidably and pivotally connected to said seating platform.

11. The chair of claim 8 wherein both of said legs are slidably and pivotally connected to said seating platform.

12. The chair of claim 11 wherein said releaseable lock is mounted on said seating platform for selective engagement with one of said legs and further including a second releasable lock mounted on said seating platform and being selectively engageable with the other of said legs.

13. The chair of claim 11 wherein said seating platform includes channel members for guiding sliding movement of said legs relative to said seating platform.

* * * * *